US011439195B1

(12) United States Patent
Corliss et al.

(10) Patent No.: US 11,439,195 B1
(45) Date of Patent: Sep. 13, 2022

(54) APPARATUS TO MANUFACTURE A GARMENT FROM A SINGLE WEB

(71) Applicant: CreateMe Technologies LLC, New York, NY (US)

(72) Inventors: Michael Corliss, Beaverton, OR (US); Nicholas Chope, Portland, OR (US); Michael William Tanguay, Camas, WA (US); Marietta Greene, Portland, OR (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/711,176

(22) Filed: Apr. 1, 2022

(51) Int. Cl.

| | |
|---|---|
| ***A41H 43/04*** | (2006.01) |
| *A41H 43/02* | (2006.01) |
| *B26D 5/00* | (2006.01) |
| *B26D 5/06* | (2006.01) |

(52) U.S. Cl.
CPC ..... *A41H 43/04* (2013.01); *A41H 43/025* (2013.01); *A41H 43/0242* (2013.01); *A41H 43/0292* (2013.01); *B26D 5/007* (2013.01); *B26D 5/06* (2013.01)

(58) Field of Classification Search
CPC .... A41H 43/04; A41H 33/00; A41H 43/0242; A41H 43/025; B26F 1/382; B26D 5/007; B26D 7/018; B26D 5/06
See application file for complete search history.

(56) References Cited

U.S. PATENT DOCUMENTS

| | | | | | |
|---|---|---|---|---|---|
| 3,663,962 | A * | 5/1972 | Burger | A41H 42/00 | 2/402 |
| 3,785,898 | A * | 1/1974 | Gerber | B29C 66/45 | 156/356 |
| 4,357,197 | A * | 11/1982 | Wilson | A41D 27/204 | 156/354 |
| 4,391,170 | A * | 7/1983 | Boverman | B26F 1/38 | 83/734 |
| 5,098,508 | A * | 3/1992 | Mattil | A43D 5/02 | 269/21 |
| 11,268,223 | B1 * | 3/2022 | Baker | D05B 27/00 | |
| 2002/0002938 | A1 * | 1/2002 | Alberts | D05B 33/00 | 112/475.09 |
| 2002/0005153 | A1 * | 1/2002 | Ribble | A41D 27/10 | 112/475.08 |
| 2008/0302460 | A1 * | 12/2008 | Angelino | A41H 43/04 | 156/60 |

* cited by examiner

*Primary Examiner* — Scott W Dodds
(74) *Attorney, Agent, or Firm* — Patterson + Shendan, LLP

(57) ABSTRACT

A garment station including a frame, a conveyor coupled to the frame, a gantry, and a folding assembly. The gantry is disposed over the conveyor and includes a tool head moveable over the conveyor. The folding assembly includes a first platen moveable relative to a second platen between a folded position and an unfolded position. The first platen is substantially co-planar with the second platen in the unfolded position. The first platen is disposed above the second platen in the folded position.

19 Claims, 16 Drawing Sheets

APPARATUS TO MANUFACTURE A GARMENT FROM A SINGLE WEB

BACKGROUND

Despite technological advances and introduction of automation in many types of manufacturing, garment manufacturing remains very labor intensive. Sewing machines were invented in the early nineteenth century and were made possible based on the development of the lock stitch sewing technique. Today, some hundred fifty years later, this same technology remains the foundation of garment manufacturing. The modern process of producing large quantities of ready-to-wear apparels relies heavily on manual labor and remains inefficient relative to other industrial manufacturing processes. Garment manufacturing includes multiple steps including sizing, folding, fitting, cutting, sewing, material handling. The type of tasks needed dictates the level of skilled labor that is required to perform the work. The unique and varied properties of fabric such as weight, thickness, strength, stretch and drape as well as the complicated nature of tasks required in apparel manufacturing complicates material handling and automated garment manufacturing.

In most small and large apparel manufacturing factories, most of the material handling and apparel manufacturing operations are conducted in a manual or semi-manual manner. The garment manufacturing process may start with laying out a web of fabric for 24 hours to relax the fabric and remove wrinkles. Then, one or more layers of fabric may be cut based on patterns and dimensions matching the desired garment. Then, the cut fabric pieces are transferred from workstation to workstation, where at each workstation, one, two, or more pieces of fabrics are manually folded, overlapped along the seams and fed into a sewing machine or serger machine (also referred to as an overlock machine). Given the variety of fabrics, threads, seam types, and stitch types found in a finished garment, a larger number of workstations with specialized tools and skilled operators is required for assembling a garment. This means the fabrics or unfinished garments spend much time in transit between workstations, which adversely affects the time required to complete a garment. Thus, traditional apparel manufacturing operations may include multiple sequential processes. Further, a time constant may be required between each operation to allow the fabric to relax, which further increases the time required to process a garment.

Despite advances in technology, machines still struggle with performing certain tasks that are easily handled by a trained worker with average hand-eye coordination skills. This is one reason the garment manufacturing industry is in a constant search of cheaper human labor rather than investing in advanced automated manufacturing systems. To increase production, a factory may add additional production lines in parallel, which does little to improve efficiency. Even in large factories, most work is performed in piecemeal fashion, with limited coordination between various stations/steps, and movement of material between each station requires a great deal of manual product handling.

Accordingly, there is a need for an automated system for manufacturing garments to increase efficiency and reduce reliance on manual labor.

SUMMARY

In one embodiment, a method of making a garment component from a single web of fabric includes moving a length of a web of fabric onto a conveyor of a garment station to make a garment component. The method further includes cutting a first cut pattern in the web disposed on the conveyor with a cutting device of the garment station. The method further includes applying an adhesive to the web to disposed on the conveyor with an adhesive dispenser of the garment station. The method further includes transporting the web from the conveyor to a folding assembly of the garment station. The method further includes cutting a second pattern in the web with the cutting device. The method further includes moving a first platen of the folding assembly from an unfolded position to a folded position to place a first portion of the web onto a second portion of the web to form an intermediate garment. The method further includes treating the intermediate garment. The method further includes moving the first platen of the folding assembly from the folded position to the unfolded position. The method further includes cutting the intermediate garment free from the web with the cutting device to form the garment component.

In one embodiment, a method of making a garment component from a single web of fabric includes indexing a length of a web of fabric onto a folding assembly of a garment station to make a garment component. The method further includes cutting a first cut pattern in the web disposed on the folding assembly with a cutting device of the garment station. The method further includes applying an adhesive to the web to disposed on the folding assembly with an adhesive dispenser of the garment station. The method further includes cutting a second pattern in the web with the cutting device. The method further includes moving a first platen of the folding assembly from an unfolded position to a folded position to place a first portion of the web onto a second portion of the web to form an intermediate garment. The method further includes treating the intermediate garment. The method further includes moving the first platen of the folding assembly from the folded position to the unfolded position. The method further includes cutting the intermediate garment free from the web with the cutting device to form the garment component.

In one embodiment, a garment station includes a frame, a conveyor coupled to the frame, a gantry, and a folding assembly. The gantry is disposed over the conveyor and includes a tool head moveable over the conveyor. The folding assembly includes a first platen moveable relative to a second platen between a folded position and an unfolded position. The first platen is substantially co-planar with the second platen in the unfolded position. The first platen is disposed above the second platen in the folded position.

BRIEF DESCRIPTION OF THE DRAWINGS

So that the manner in which the above recited aspects are attained and can be understood in detail, a more particular description of embodiments described herein, briefly summarized above, may be had by reference to the appended drawings.

It is to be noted, however, that the appended drawings illustrate typical embodiments and are therefore not to be considered limiting; other equally effective embodiments are contemplated.

FIG. 1A is a top perspective view of the garment station. FIG. 1B is a top view of the garment station. FIG. 1C is a schematic perspective of a first platen in a folding assembly.

FIG. 2A illustrates a top view of the garment station with a single web of fabric disposed thereon. FIG. 2B illustrates a top view of the garment station showing a first cut pattern in the web and an adhesive applied to the web. FIG. 2C illustrates a top view of the garment station illustrating the web after the web transported to a folding assembly of the garment station. FIG. 2D illustrates a top view of the garment station showing a second cut pattern in the web. FIG. 2E is a perspective view of the garment station as the folding assembly is being folded. FIG. 2F illustrates a top view of the garment station showing a folded folding assembly. FIG. 2G illustrates a top view of the garment station showing an intermediate garment. FIG. 2H illustrates a top view of the garment station showing the garment component.

FIG. 3A illustrates at top view of the garment station with a single web disposed therein. FIG. 3B illustrates a top view of the garment station showing an intermediate garment.

DETAILED DESCRIPTION

Figure 1A:
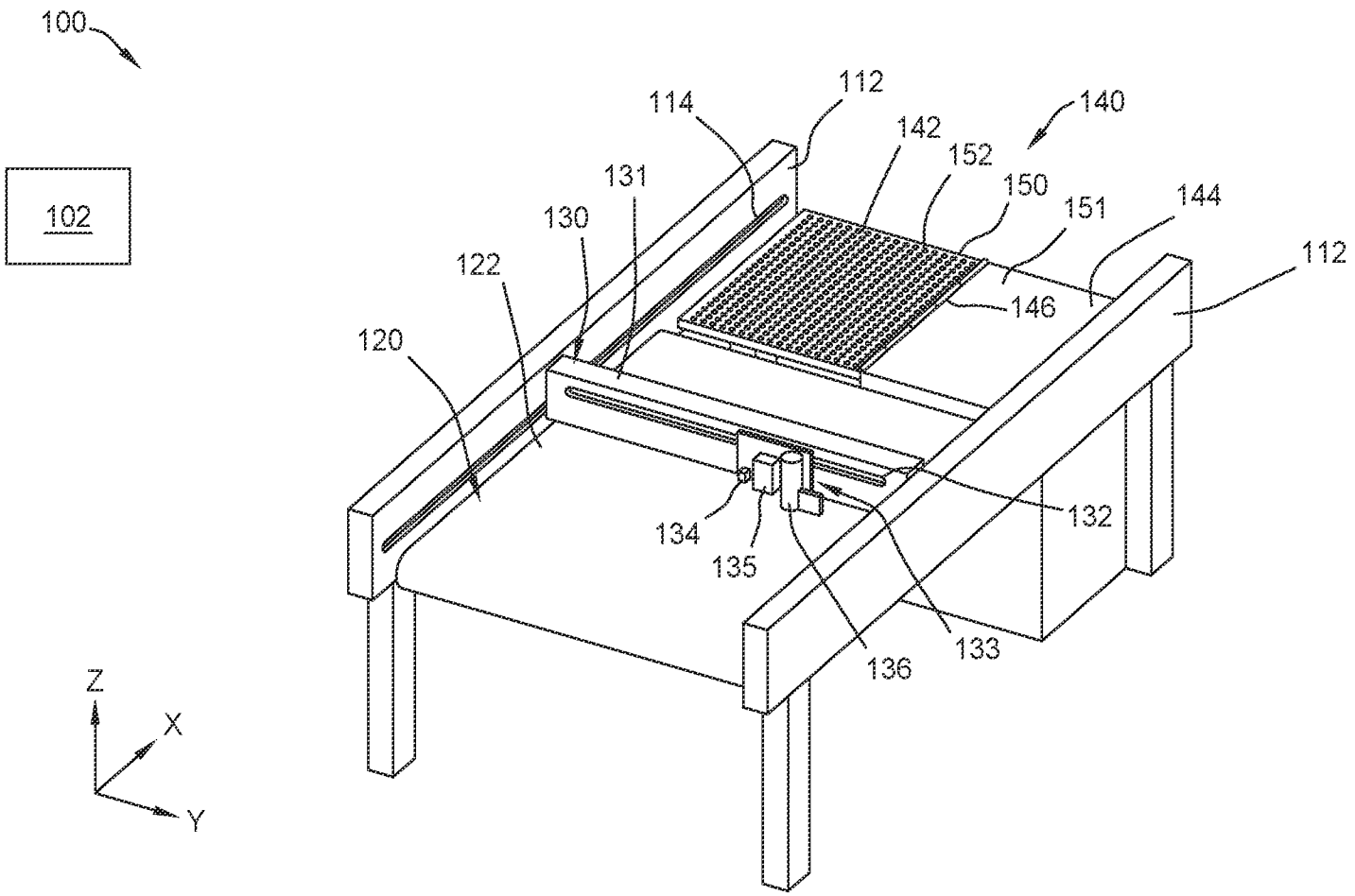
FIGS. 1A-1C illustrate a garment station.
Figure 1B:
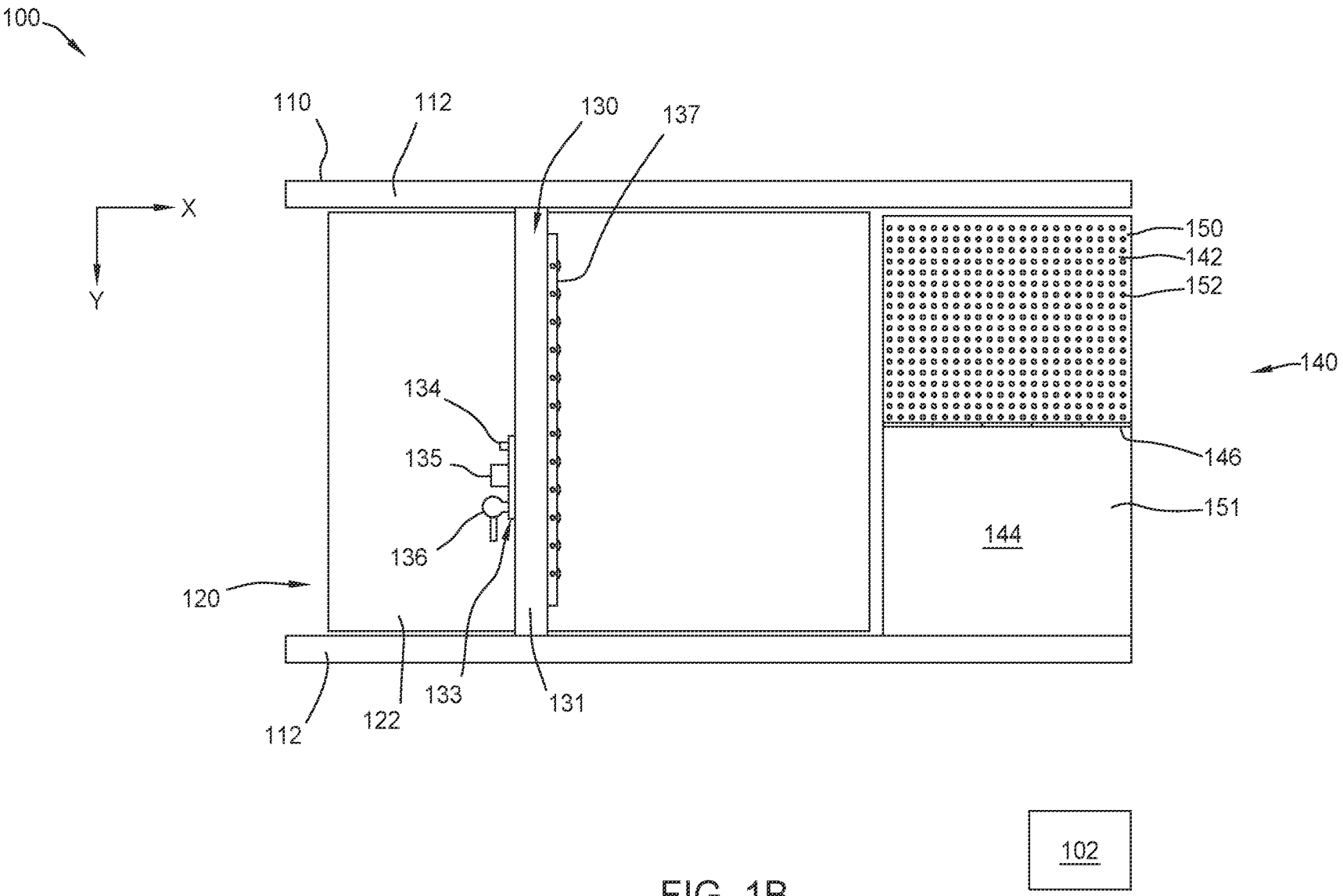
Figure 1C:
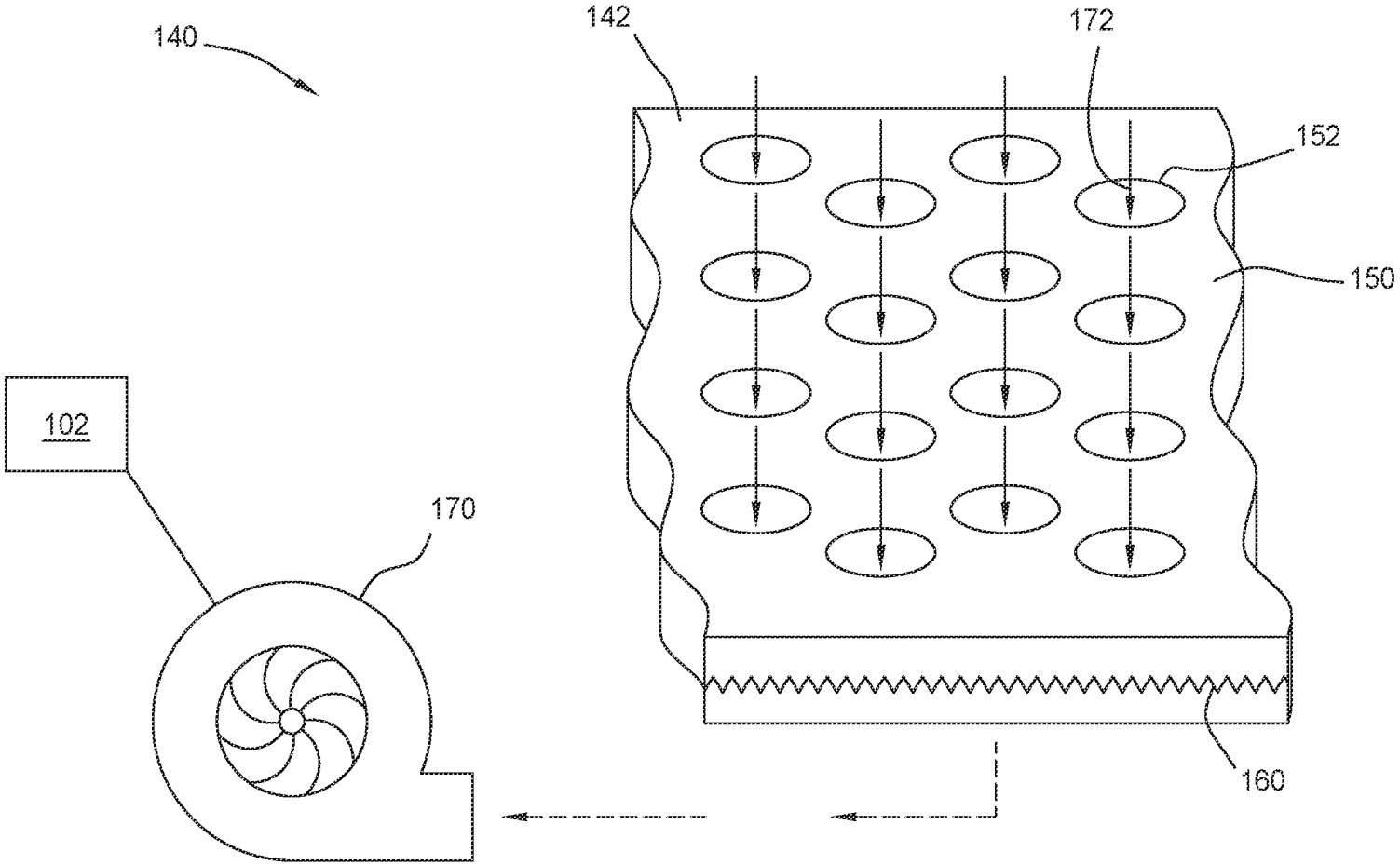

FIGS. 1A-1C are schematic illustrations of an exemplary garment station 100 for manufacturing one or more garment components from a single web of fabric. The garment station 100 may include a controller 102, a frame 110, a conveyor 120, a gantry 130, and a folding assembly 140. The garment station 100 is includable in a garment manufacturing system, such as an automated garment manufacturing system.

As shown in FIG. 1A, the frame 110 includes two side members 112. Each side member 112 includes a side track 114. The conveyor 120 is disposed in the frame 110. The conveyor 120 includes one or more rollers (not shown in FIGS. 1A-1C) and a belt 122. The conveyor 120 may be supported by the frame 110, and an end of each roller may be coupled to or mounted on the frame 110. The controller 102 may instruct the conveyor 120 to convey a web fabric.

The gantry 130 includes a body 131, a gantry track 132, a tool head 133, and a gripper 137. The gantry 130 is engaged with each side track 114 of the frame 110. The side tracks 114 may be motorized to move the gantry 130, or the gantry 130 may have an actuator (not shown) to move the gantry 130 along the side tracks 114. The gantry 130 may move along the side tracks 114 relative to the frame 110, conveyor 120, and the folding assembly 140. The tool head 133 is engaged with the gantry track 132. The gantry track 132 may be motorized to move the tool head 133, or the tool head 133 may have an actuator (not shown) to move the tool head 133 along the gantry track 132. The controller 102 may instruct the gantry 130 to move along the side tracks 114. The controller 102 instructs the tool head 133 to move along the gantry track 132. The controller 102 instructs the gantry 130 and the tool head 133 to move simultaneously.

In some embodiments, the tool head 133 includes an optical sensor 134, a cutting device 135, and an adhesive dispenser 136. The optical sensor 134 may be a camera. The optical sensor 134 captures one or more images of a fabric disposed on the conveyor 120 or the folding assembly 140. The controller 102 may analyze the one or more images of the fabric to establish the position of the fabric, such as the position of the fabric on the conveyor 120 and/or the folding assembly 140. The cutting device 135 is configured to cut the fabric. The cutting device 135 may be a rotary cutter, a rotary die cutting device, a kiss cutting device, a die cutting device, a laser cutting device, a drag knife, or other suitable cutter. The adhesive dispenser 136 may apply an adhesive to the fabric. The adhesive dispenser 136 may be a needle valve, a diaphragm valve, a pneumatic valve, an electro-pneumatic jet valve, a piezoelectric jet valve, a tape dispenser, a liquid adhesive dispenser, or other suitable dispenser. The adhesive may be a heat activated adhesive. The adhesive may also be cured by a moisture treatment, such as exposing the adhesive to moisture. The controller 102 may cause the optical sensor 134 to image the fabric, cause the cutting device 135 to cut the fabric, and cause the adhesive dispenser to apply the adhesive to the fabric.

The gantry 130 is moveable along the side tracks 114 to position the tool head 133 along the x-axis. The tool head 133 is moveable along the gantry track 132 to position the tool head 133 on the y-axis. The controller 102 instructs the gantry 130 and the tool head 133 to move the tool head 133 to positions along the x,y axes. In some embodiments, the controller 102 instructs the cutting device 135 to cut the fabric, instructs the adhesive dispenser 136 to apply the adhesive, and instructs the optical sensor 134 to obtain one or more images as the tool head 133 is moved to positions along the x,y axes.

The gripper 137 is configured to clamp, grip and/or lift a fabric disposed on the conveyor 120. The gripper 137 may be a vacuum bar as shown in FIG. 1B. The gripper 137 may be actuated by the controller 102 to grip and/or lift the fabric while the fabric is transported at least partially onto the folding assembly 140. The gripper 137 may be disposed on the opposite side of the body 131 as the gantry track 132 and the tool head 133. In alternative embodiments, the gripper 137 may use fixed or retractable pins, hooks, robotic fingers equipped with pressure sensors to provide feedback to the controller 102 as to the amount of force exerted on the fabric by the gripper 137. In yet other embodiments, the gripper 137 may include rollers enveloped in rubber or other material that provide adequate friction against the fabric to allow the moving and manipulation of the fabric in a two-dimensional or three-dimensional environment.

The folding assembly 140 includes a first platen 142 and a second platen 144. The first platen 142 has an upper surface 150 and the second platen 144 has an upper surface 151. In some embodiments, and as shown in FIGS. 1A and 1B, the first platen 142 is rotatable relative to the second platen 144. In one example, the first platen 142 may be pivotally coupled to the second platen 144 by one or more hinges 146. The first platen 142 is moveable from an unfolded position (FIG. 1A) to a folded position (FIG. 2F). The upper surfaces 150, 151 of the first and second platens 142, 144 are generally co-planar in the unfolded position of the first platen 142. The surface 150 of the first platen 142 has been rotated to face the upper surface 151 of the second platen 144 in the folded position of the first platen 142. The first platen 142 is moved from the unfolded position to the folded position to place a portion of a single web of fabric disposed on the first platen 142 onto another portion of the single web of fabric disposed on the second platen 144. An actuator (not shown) may be used to move the first platen 142 between the unfolded and folded positions. For example, the actuator may pivot the first platen 142 about the hinges 146 to dispose the first platen 142 above the second platen 144. In some embodiments, the actuator may be a mechanized hinge or a piston assembly. In some embodiments, and as shown in FIG. 1A-1B, the second platen 144 may be fixed in space relative to the frame 110 such that the second platen 144 does not move while the first platen 142 moves between the folded and unfolded positions.

FIG. 1C illustrates a schematic view of the first platen 142. The first platen 142 has an upper surface 150 and a plurality of perforations 152. In some embodiments, the first platen 142 also includes one or more heating elements 160. The one or more heating elements 160 heat the first platen 142, and the heat may be used to activate and/or cure the adhesive applied to a fabric. The first platen 142 may be made of a material with a sufficient thickness and thermal properties to maintain a temperature when heated by the heating elements 160 sufficient to activate and/or cure the adhesive. The folding assembly 140 may also include a vacuum pump 170 coupled to the perforations 152 of the first platen 142. For example, the vacuum pump 170 may draw atmospheric air into the perforations as shown by arrows 172. As the vacuum pump 170 draws air into the perforations 152, the fabric is securely held against the upper surface 150 of the first platen 142. The vacuum pump 170 may be selectively activated by the controller 102 to hold the fabric against the upper surface 150 of the first platen 142 while the first platen 142 is moved to the folded position to place the fabric held against the upper surface 150 of the first platen 142 onto fabric disposed on the upper surface 151 of the second platen 144.

In some embodiments, the second platen 144 also includes perforations in communication with a vacuum pump to hold the fabric against the second platen 144. In some embodiments, the same vacuum pump is used to hold the fabric against the first platen 142 and the second platen 144. In some embodiments, the second platen 144 includes the heating elements 160 instead of the first platen 142. In some embodiments, both the first platen 142 and the second platen 144 include heating elements.

In some embodiments, the folding assembly 140 includes a clamp (not shown) instead of a vacuum pump to retain the single web of fabric in position on the first platen 142 as the first platen 142 is moved from the unfolded position to the folded position.

Figure 2A:
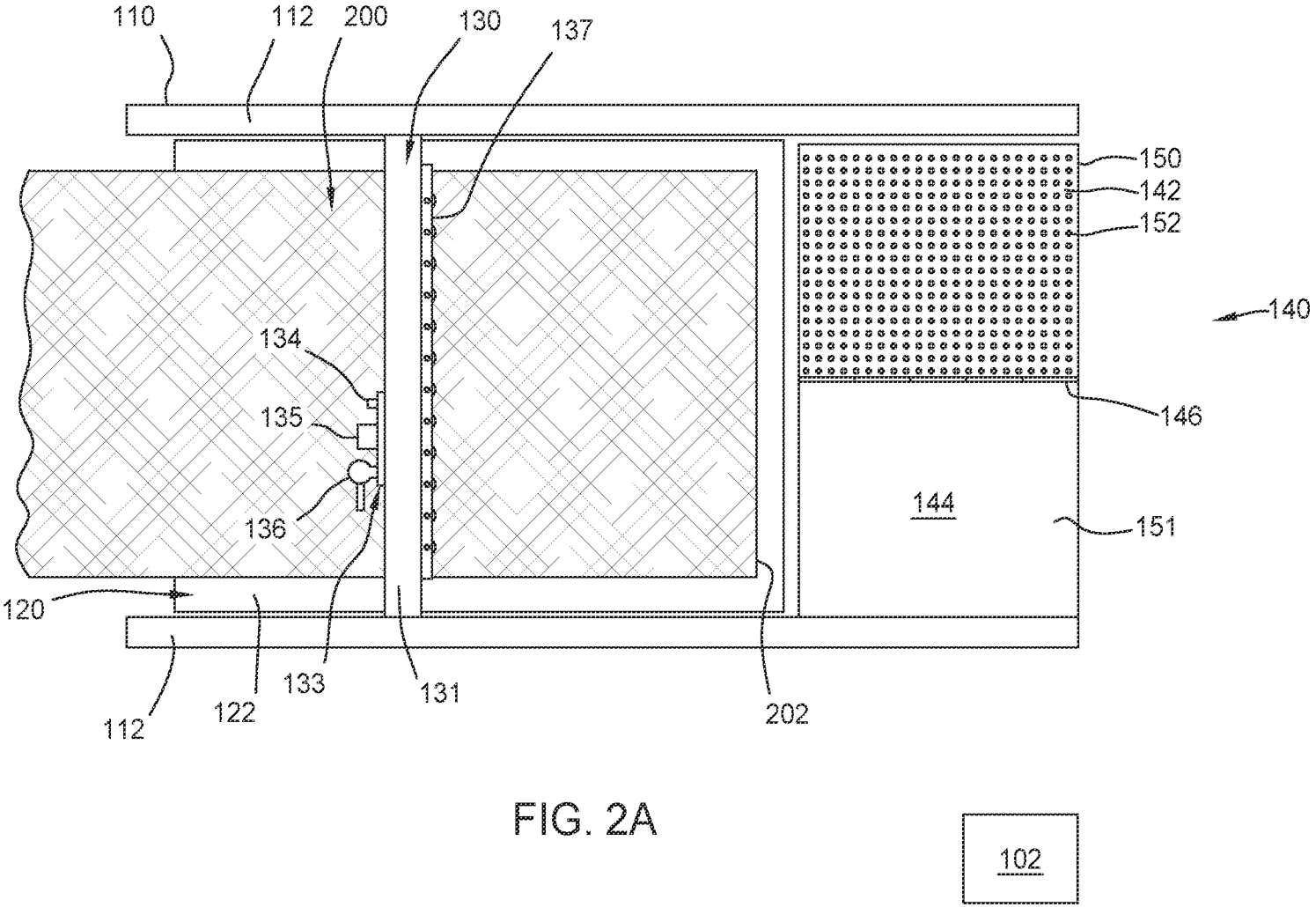
FIGS. 2A-2H illustrate making a garment component from a single web of fabric with the garment station.
Figure 2B:
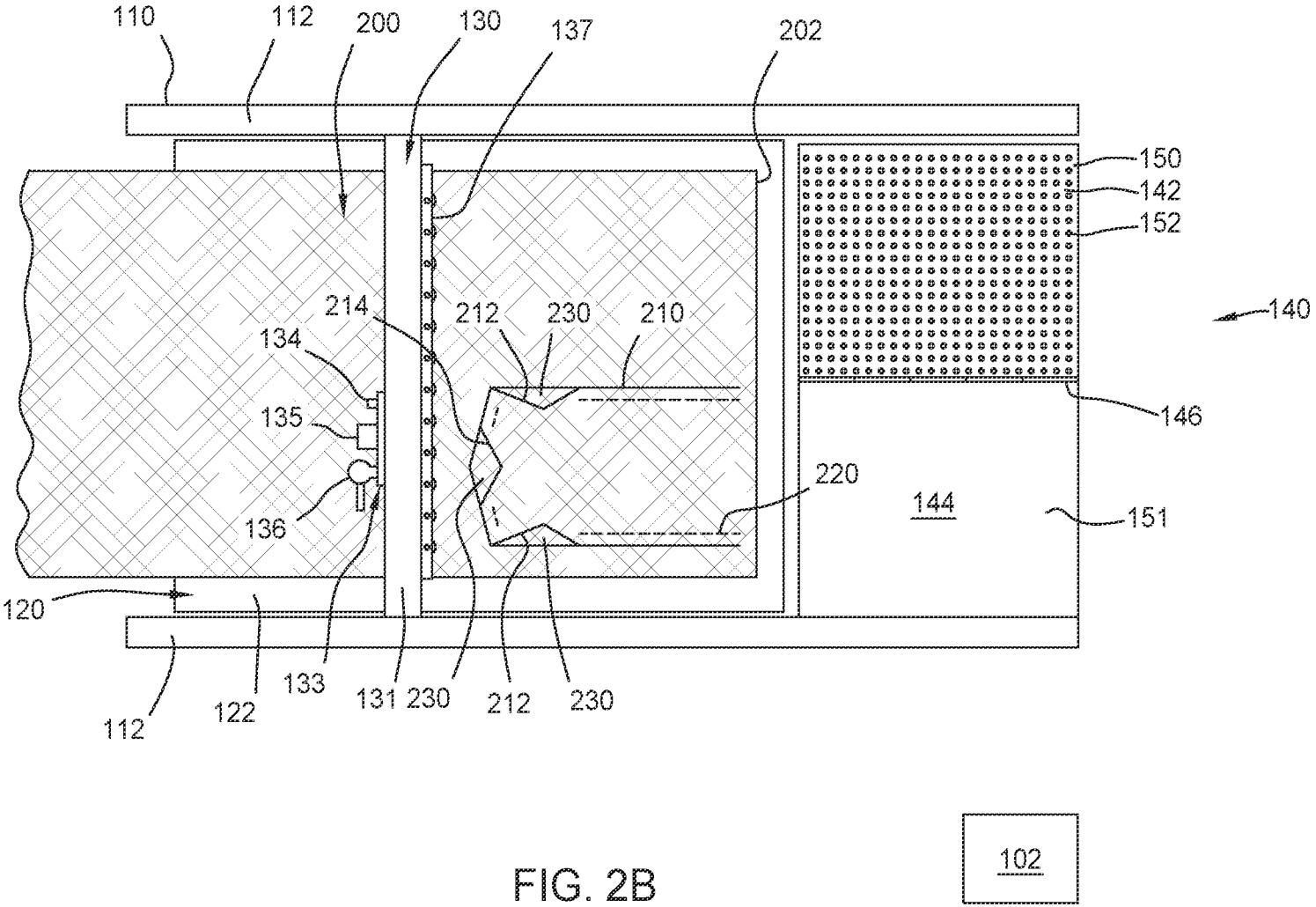
Figure 2C:
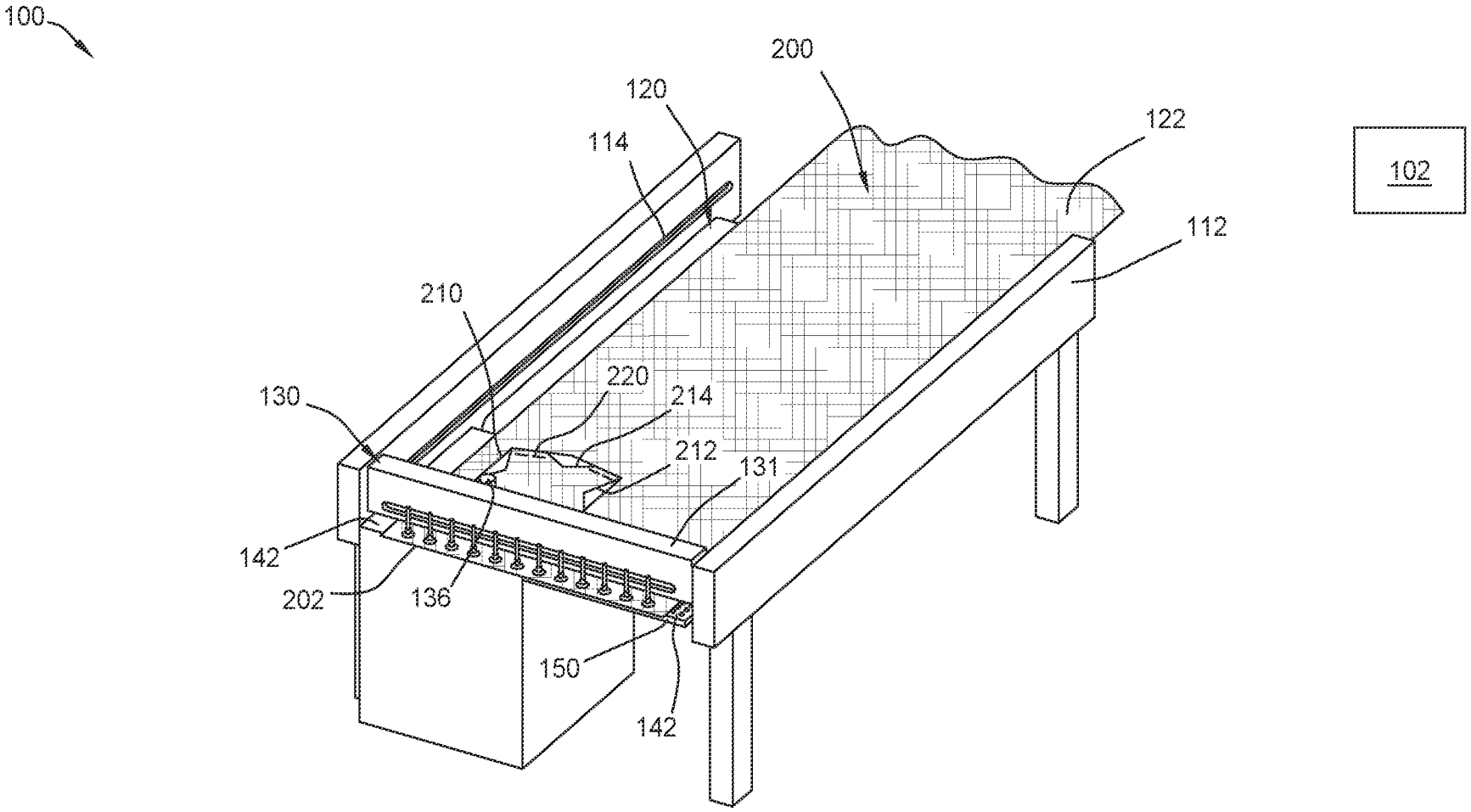
Figure 2D:
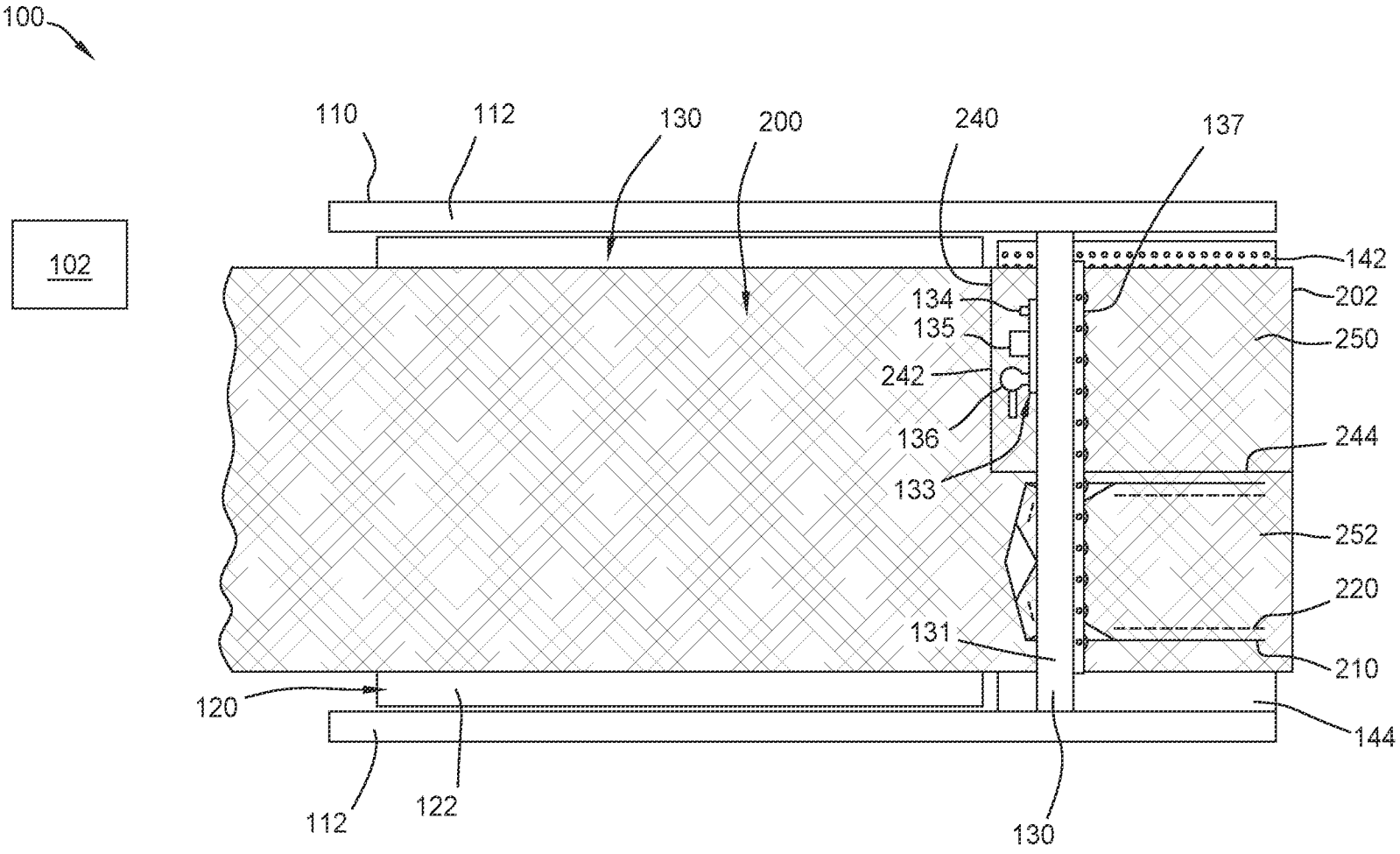
Figure 2E:
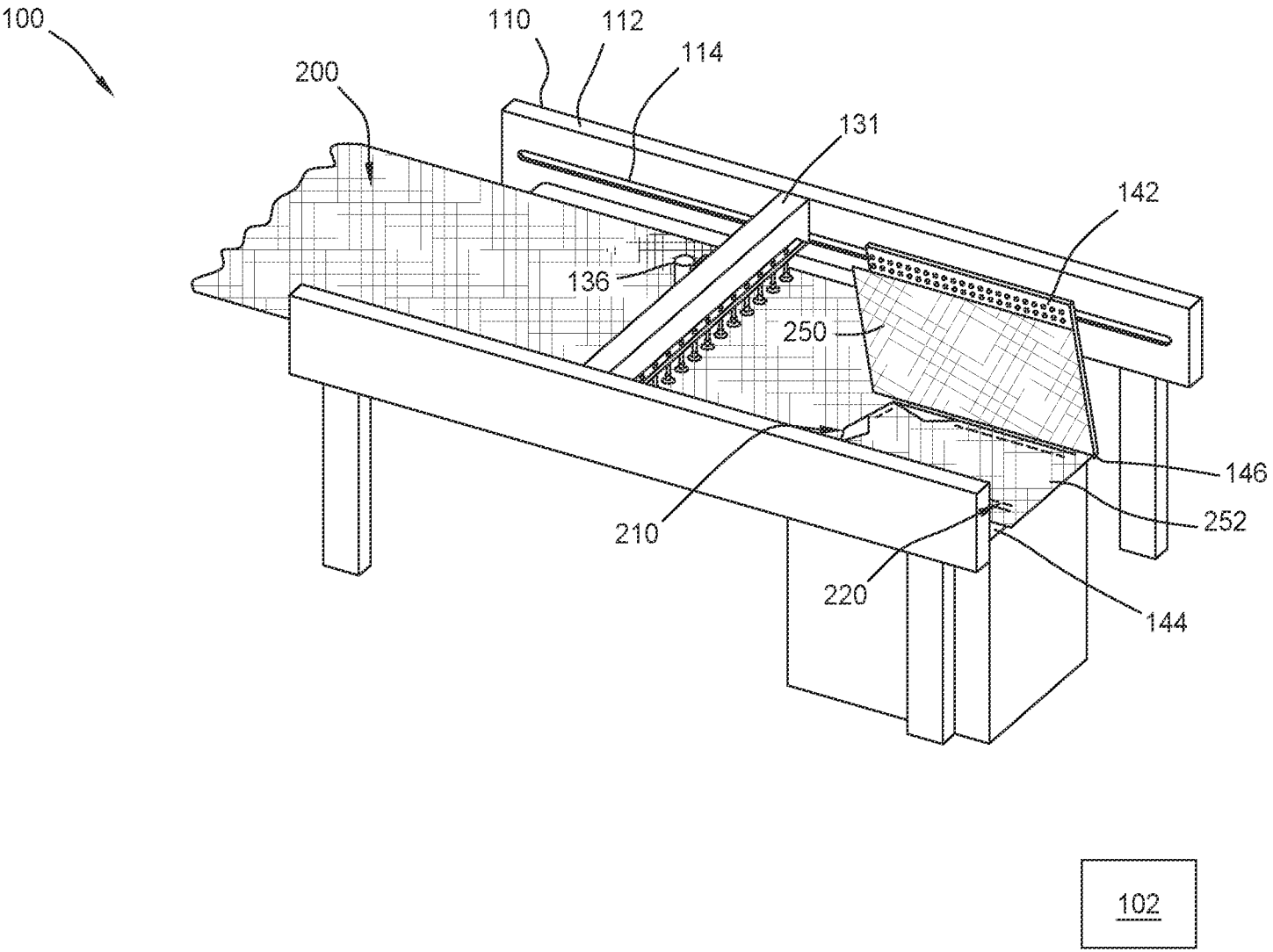
Figure 2F:
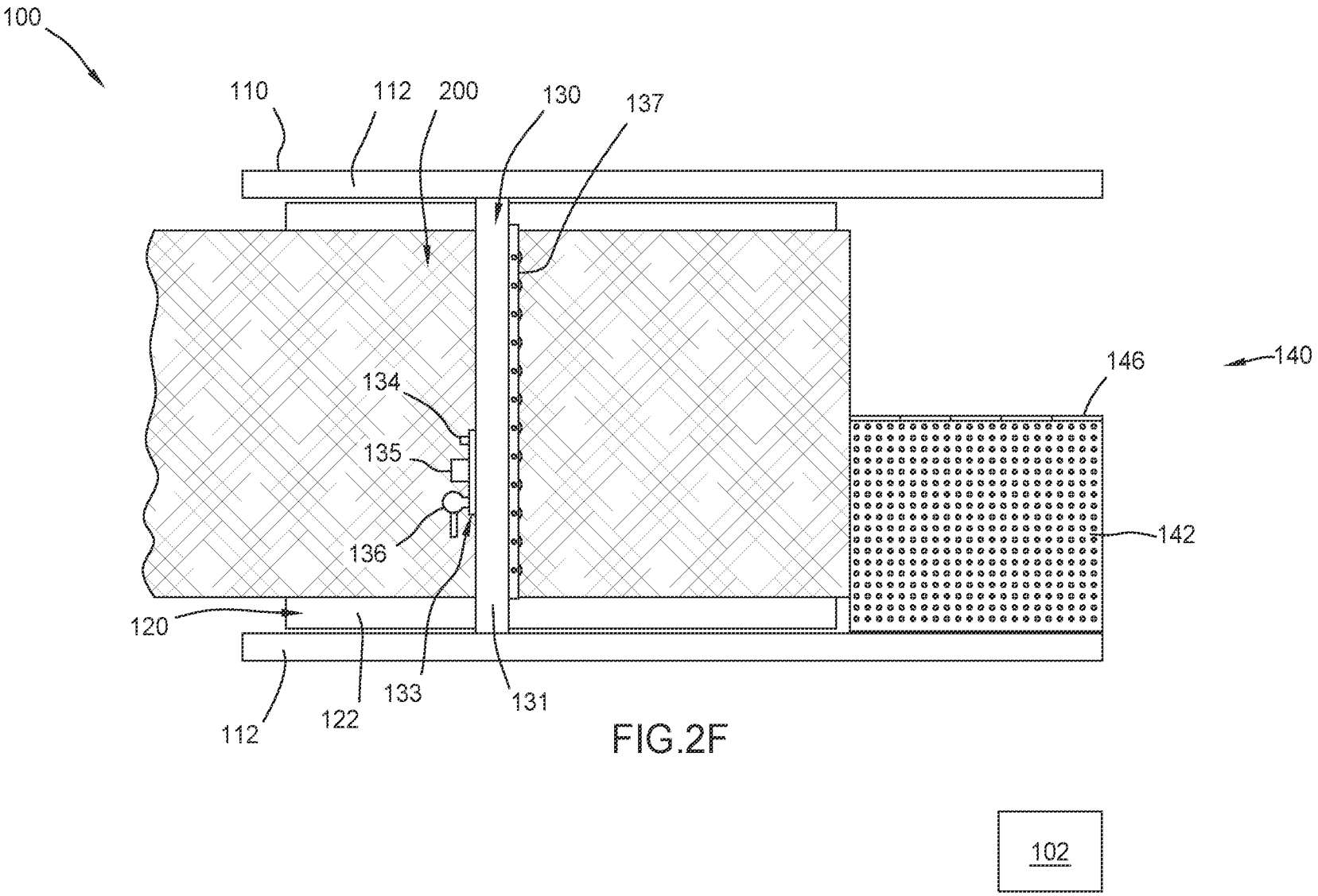

FIGS. 2A-2H illustrate forming a garment portion with the garment station 100. As shown in FIG. 2A, a single web 200 of fabric is transported into the garment station 100. The web 200 is placed on the conveyor 120. The conveyor 120 may grip the web 200. The conveyor 120 may grip the web 200 with, for example, a vacuum, hook, clamps, and the like. The web 200 may include one or more positioning features that allow the controller 102 to precisely position the web within the garment station 100. The positioning features may be a notch or marking in the edge or side of the web 200, cut or glue beads, markings, or other features or indicias that may be used to identify a specific location of the web relative to the garment station 100. The conveyor 120 moves the web 200 to a position directed by the controller 102. In some embodiments, the controller 102 causes the conveyor 120 to index a length of the web 200 onto the conveyor 120 sufficient to form the desired garment component. In some embodiments, the controller 102 may move the tool head 133 to image one or more positioning features of the web 200 with the optical sensor 134 to precisely determine the position of the web 200 on the conveyor 120.

In some embodiments, the web 200 is cut and adhesive is applied thereto while the web 200 is positioned on the conveyor 120. FIG. 2B illustrates the web 200 after the first cut pattern 210 is cut in the web 200 and after an adhesive 220 is applied to the surface of the web 200. The adhesive 220 may be applied in an adhesive pattern. The cutting device 135 is attached to the gantry 130 and is moved about the x,y axes with the tool head 133 to form the first cut pattern 210 in the web 200. The cutting device 135 may cut the first pattern 210 in response to one or more instructions from the controller 102. The adhesive dispenser 136 is moved about the x,y axes to apply the adhesive 220 to the web 200 in response to one or more instructions from the controller 102. The adhesive 220 may be applied to the web 200 to form a seam when the web 200 is folded by the folding assembly 140. The web 200 may be cut with the cutting device 135 to form the first cut pattern 210 before or after applying the adhesive 220 with the adhesive dispenser 136. In some embodiments, the controller 102 coordinates the movement of the tool head 133 above the web 200 to cut and apply adhesive to portions of the web 200 simultaneously. The first cut pattern 210 and the adhesive 220 remain attached to the web 200, and the first cut pattern 210 and the adhesive 220 are conveyed as part of the web 200 to the folding assembly 140 for further processing.

The controller 102 may instruct the garment station 100 to form the first cut pattern 210, such as the front body of a t-shirt as shown in FIG. 2B, and to apply the adhesive 220 based on a garment component pattern. The first cut pattern 210 may be a garment pattern. The first cut pattern 210 may be stored in the controller 102 and selectively changed based on the desired garment component. The first cut pattern 210 may include sleeve joints 212 and a neck line 214 of the t-shirt. One or more cut pieces 230 may be formed as the web 200 is cut by the cutting device 135 to form the first cut pattern 210. The adhesive 220 may be applied in a pattern, such as a seam pattern, based on the garment component pattern.

In some embodiments, the web 200 is moved onto the folding assembly 140 after forming the first cut pattern 210 and applying adhesive 220 to the web 200. FIG. 2C illustrates the web 200 after the web 200 is transported to the folding assembly 140 from the conveyor 120 to place the first cut pattern 210 onto the second platen 144. Prior to transporting the web 200 onto the folding assembly 140, the gantry 130 is moved to a position above the web 200. For example, the gantry 130 may be moved to position the gripper 137 adjacent the leading edge 202 of the web 200. Once the gantry 130 is in position above the web 300, the gripper 137 is actuated to grip the web 200. The gripper 137 may also be further actuated to lift the web 200 partially from the surface of the conveyor 120. The controller 102 may then instruct the conveyor 120 and the gantry 130 to move synchronously to transport the gripped web 200 onto the folding assembly 140. Movement of the conveyor 120 and the gantry 130 may be coordinated to prevent or mitigate wrinkling of the web 200. In some embodiments, the one or more cut pieces 230 may fall through a gap between the conveyor 120 and the folding assembly 140 into a waste receptacle (not shown) as the first cut pattern 210 is transported onto the folding assembly 140 from the conveyor 120. In some embodiments, the cut pieces 230 are removed manually or by a robotic assembly, such as a robotic arm with one or more suction cups. Once the web 200 is transported onto the folding assembly, as shown in FIG. 2C, the controller 102 may instruct the gripper 137 to release the web 200. The vacuum pump 170 may be turned off as the web 200 is transported onto the folding assembly 140.

In some embodiments, the cutting device 135 is moved about the x,y axes to form the second cut pattern 240 in the web 200 as shown in FIG. 2D in response to one or more instructions from the controller 102 after the web 200 is transported onto the folding assembly 140. The second cut pattern 240 facilitates placing a first web portion 250 engaged with the first platen 142 onto a second web portion 252 engaged with the second platen 144 as first platen 142 is moved from the unfolded position to the second position. The second cut pattern 240 is cut free from the first web portion 250 so as the first web portion 250 is onto the second web portion 252 by the first platen 142, the second cut pattern 240 is placed over the first cut pattern 210. Optionally, the second cut pattern 240 may be cut free from the second web portion 252 after the second cut pattern 240 is placed over the first cut pattern 210 by the motion of the first platen 142. The second cut pattern 240 may have a first portion 242 along the y-axis and a second portion 244 along the x-axis. The second cut web portion 252 may optionally be fully severed from the first web portion 250 as shown in FIG. 2D. In some embodiments, the second portion 244 is omitted, and the web 200 is folded by the folding assembly 140 as the first platen 142 moves from the unfolded position to the folded position. For example, the web 200 may be folded about a line of symmetry of the web 200. In some embodiments, the vacuum pump 170 may be activated by the controller 102 prior to and during the movement of the first platen 142 to prevent the first web portion 250 from moving relative to the first platen 142 so that that the first web portion 252 can be precisely placed on the second web portion 252. In some embodiments, the vacuum pump 170 may be activated by the controller 102 prior to and during the formation of the second cut pattern 240. In some embodiments, the optical sensor 134 is moved about the x,y axes prior to the formation of the second cut pattern 240 to obtain one or more images of the web 200, including the of the first cut pattern 210 and the adhesive 220 and positioning features. The controller 102 may analyze these one or more images to establish the position of web 200 on the folding assembly 140, such as the position of the first cut pattern 210 and the adhesive 220 on the second platen 144 relative to a point of reference. The positional information may be stored by the controller 102. The controller 102 may cause the cutting device 135 to move about the x,y axes to form the second cut pattern 240 based on the location of web 200, such as the location of the first cut pattern 210.

In some embodiments, the second cut pattern 240 is formed in the web 200 on the conveyor 120 before, during, or after the formation of the first cut pattern 210. The first cut pattern 210 and the second cut pattern 240 may be transported from the conveyor 120 to the folding assembly 140 after being gripped and/or lifted by the gripper 127 of the gantry 130.

In some embodiments, the optical sensor 134 is moved about the x,y axes after the formation of the second cut pattern 240 to obtain one or more images of the web 200, including the features of the first cut pattern 210, the adhesive 220, and the second cut pattern 240. The controller 102 may analyze these one or more images to establish the position of web 200 on the folding assembly 140, such as the position of the first cut pattern 210 and the adhesive 220 on the second platen 144 relative to a point of reference. The positional information may be stored by the controller 102.

As shown in FIG. 2D, the first web portion 250 of the web 200 is engaged with the first platen 142. The second web portion 252 of the web 200, including the first cut pattern 210 and the adhesive 220, is engaged with the second platen 144. The first web portion 250 is placed onto the second web portion 252 by the first platen 142 the folding assembly 140.

FIG. 2E illustrates the garment station 100 in the process of moving the first platen 142 of the folding assembly 140 from the unfolded position to the folded position. The folding assembly 140 may be instructed by the controller 102 to place the first web portion 250 onto the second web portion 252 after the second cut pattern 240 is formed in the web 200. The controller 102 commands the vacuum pump 170 to provide a vacuum that holds the first web portion 250 against the surface 150 of the first platen 142. The controller 102 may then instruct the actuator (not shown) to pivot the first platen 142 about the hinges 146 to place the first web portion 250 onto the second web portion 252. In some embodiments, the second web portion 252 may also be held against the second platen 144 by a vacuum source, such as a vacuum pump, while the folding assembly 140 is actuated to pivot the first platen 142 about the hinges 146.

FIG. 2F illustrates the first platen 142 of the folding assembly 140 in the folded position. The first platen 142 is shown folded onto the second platen 144. The first web portion 250 and the second web portion 252 are sandwiched between the first platen 142 and the second platen 144 to form an intermediate (e.g., partially formed) garment 254. The first web portion 250 is bonded to the second web portion 252 by the adhesive 220. The intermediate garment 254 may be treated by the folding assembly 140 while the first platen 142 is in the folded position. The treatment may include a heat and/or pressure treatment. Heat and pressure may be applied to the first web portion 250 and the second web portion 252 to activate and/or cure the adhesive to bond the first web portion 250 to the second web portion 252. The heat may be provided by the heating elements 160 in the first platen 142. The second platen 144 may not be heated to avoid premature activation of the adhesive 220 prior to the placement of the first web portion 250 onto the second web portion 252. In one example, between 1 psi and 10 psi of pressure may be applied by the first platen 142 against the second platen 144, thus applying the same pressure to clamp together the first and second web portions 250, 252. In some embodiments, the intermediate garment may be treated with moisture in addition to the heat and/or pressure treatment. For example, the moisture treatment may include blowing humid air at the intermediate garment.

Figure 2G:
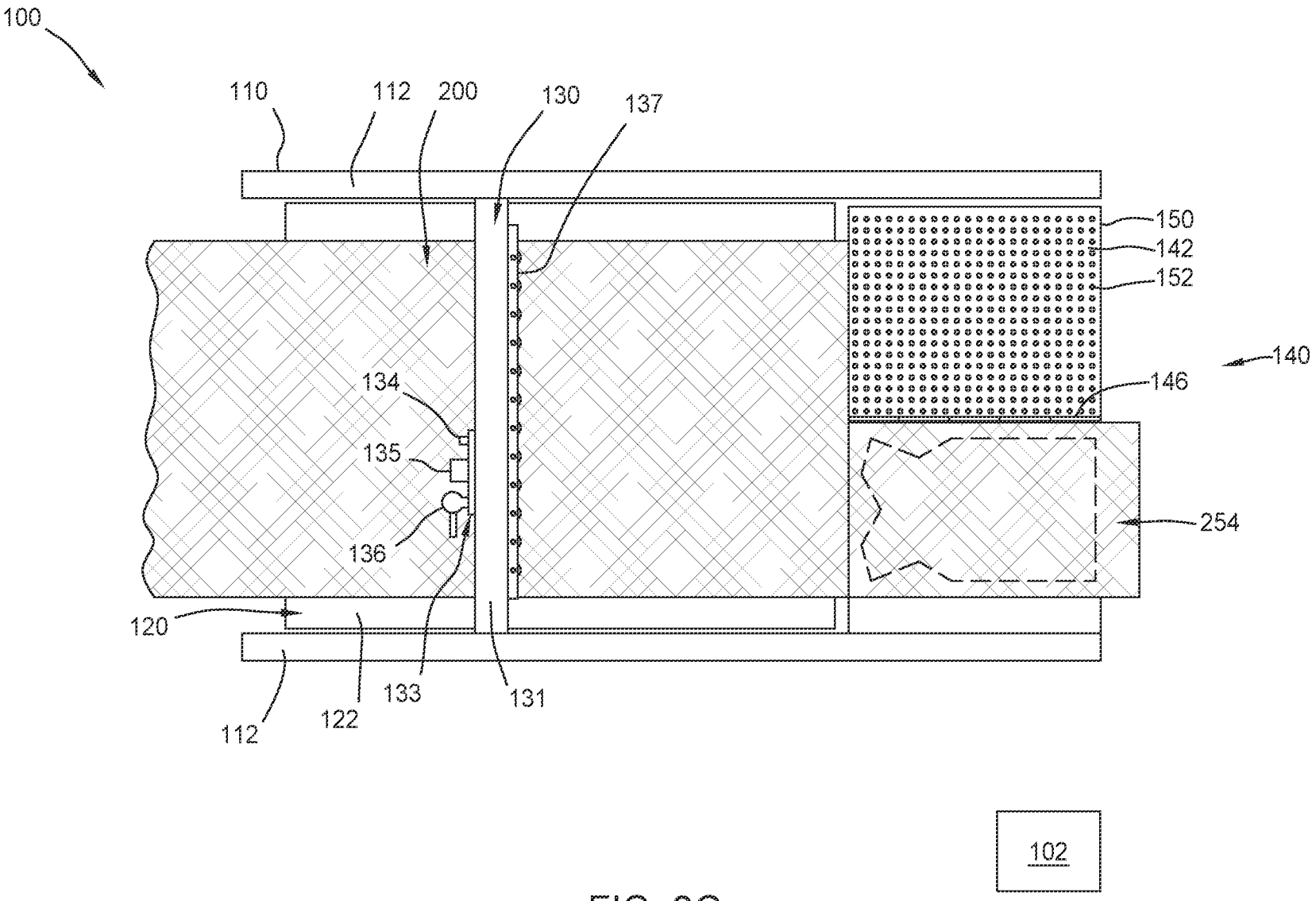

FIG. 2G illustrates the garment station 100 after the first platen 142 is returned to the unfolded position to reveal the intermediate garment 254. The controller 102 commands the vacuum pump 170 to stop applying a vacuum prior to commanding the first platen 142 to move from the folded position to the unfolded position. As shown in FIG. 2G, the first web portion 250 covers the first cut pattern 210 and the placement of the adhesive 220 on the second web portion 252. Because the second web portion 252 was not moved during the movement of the first platen 142, the controller 102 may use the stored location of the first cut pattern 210 and the adhesive 220 to cut the intermediate garment 254 free of the web 200 to form a finished garment 270. Cutting the intermediate garment 254 free from the web 200 may include cutting the intermediate garment 254 to form one or more contours of the finished garment 270, such as a shoulder joint or a neckline. In some embodiments, the intermediate garment 254 may be cut to form a shoulder joint in the first web portion 250 without cutting the previously formed shoulder joint 212 of the second web portion 252 as the intermediate garment 254 is cut free from the web 200. In some embodiments, the contour of the shoulder joint in the first web portion 250 may be different than the counter of the shoulder joint 212 in the second web portion 252. A neck line may also be cut into the first web portion 250.

Figure 2H:
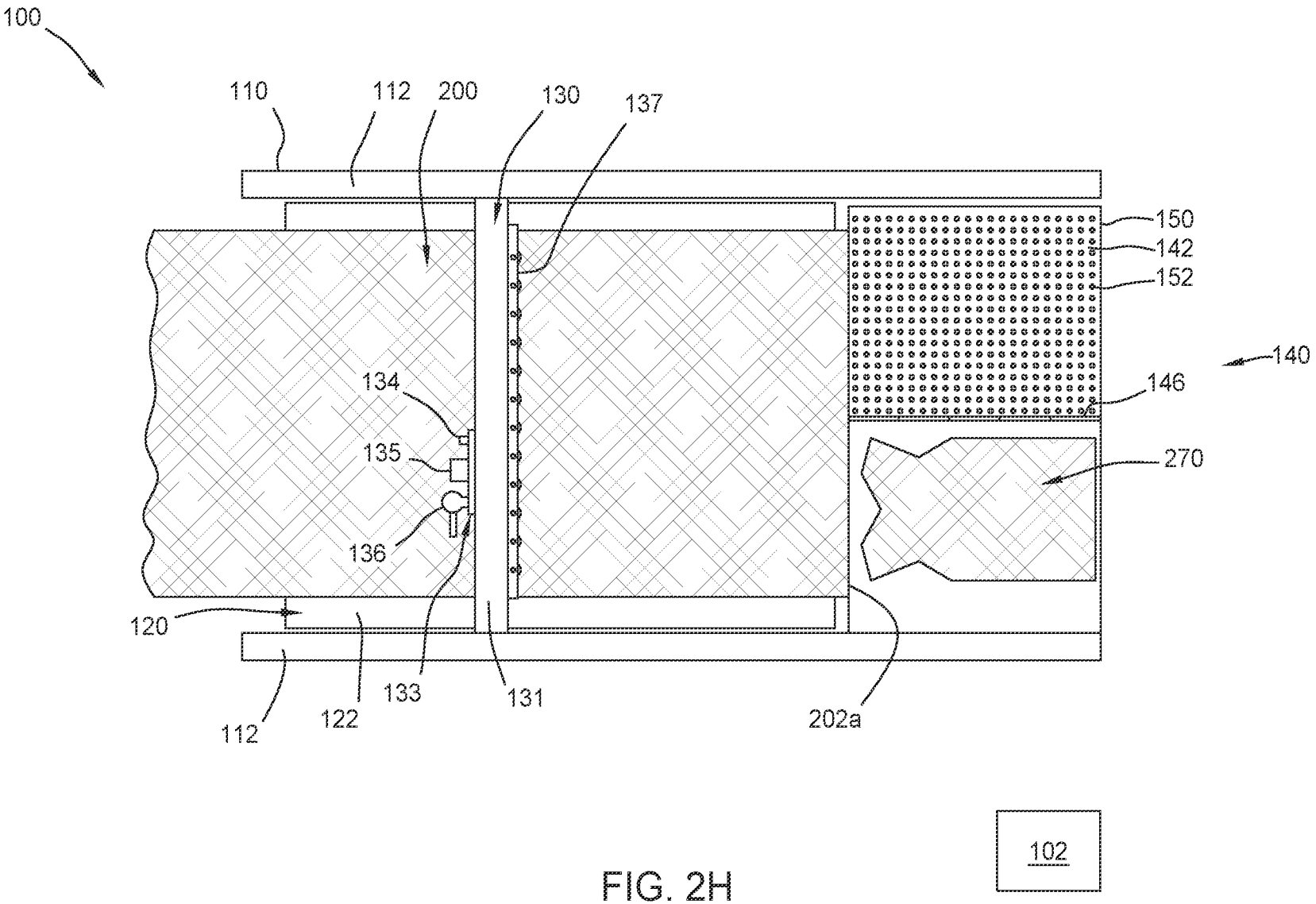

FIG. 2H illustrates the finished garment component 270 after the intermediate garment 254 is cut by the cutting device 135. The finished garment component 270 is a two layered garment component formed from a single web 200 of the fabric. The excess web material (not shown) has been removed. The excess material may be removed by hand or by a robotic assembly, such as a robotic arm with one or more suction cups. In addition to instructing the cutting device 135 to cut the first web portion 250 to create the finished garment component 270, the controller 102 may also instruct the cutting device 135 to cut a new leading edge 202*a* to the end of the web 200. In some embodiments, the new leading edge 202*a* is included in the second cut pattern 240 or is formed while the first platen 142 is in the folded position.

The finished garment component 270 may be removed from the folding assembly manually or by a robotic assembly, such as a robotic arm with one or more suction cups. The finished garment component 270 may be further processed, such as being placed to finish allowing the adhesive to cure, or having sleeves attached to complete the manufacturing process to turn the finished garment component 270 into a completed garment ready for use or sale. The controller 102 may then instruct the garment station 100 to begin the process again to make another finished garment component 270. The next garment component may be the same type and size of garment component, or the next garment component may be a different type and/or size of garment component. In some embodiments, the finished garment may be treated with moisture, such as blowing humid air at the finished garment, to cure the adhesive.

In the depicted embodiment, the finished garment component 270 is inside out such that a portion of the finished garment component 270 that would contact a body of a wearer is shown. The garment component 270 may be turned inside out prior to being worn to hide seams formed where the first and second web portions 250, 252 are adhered. In some embodiments, the garment component may not need to be turned inside out after the garment component 270 is cut from the intermediate garment 254.

Figure 3A:
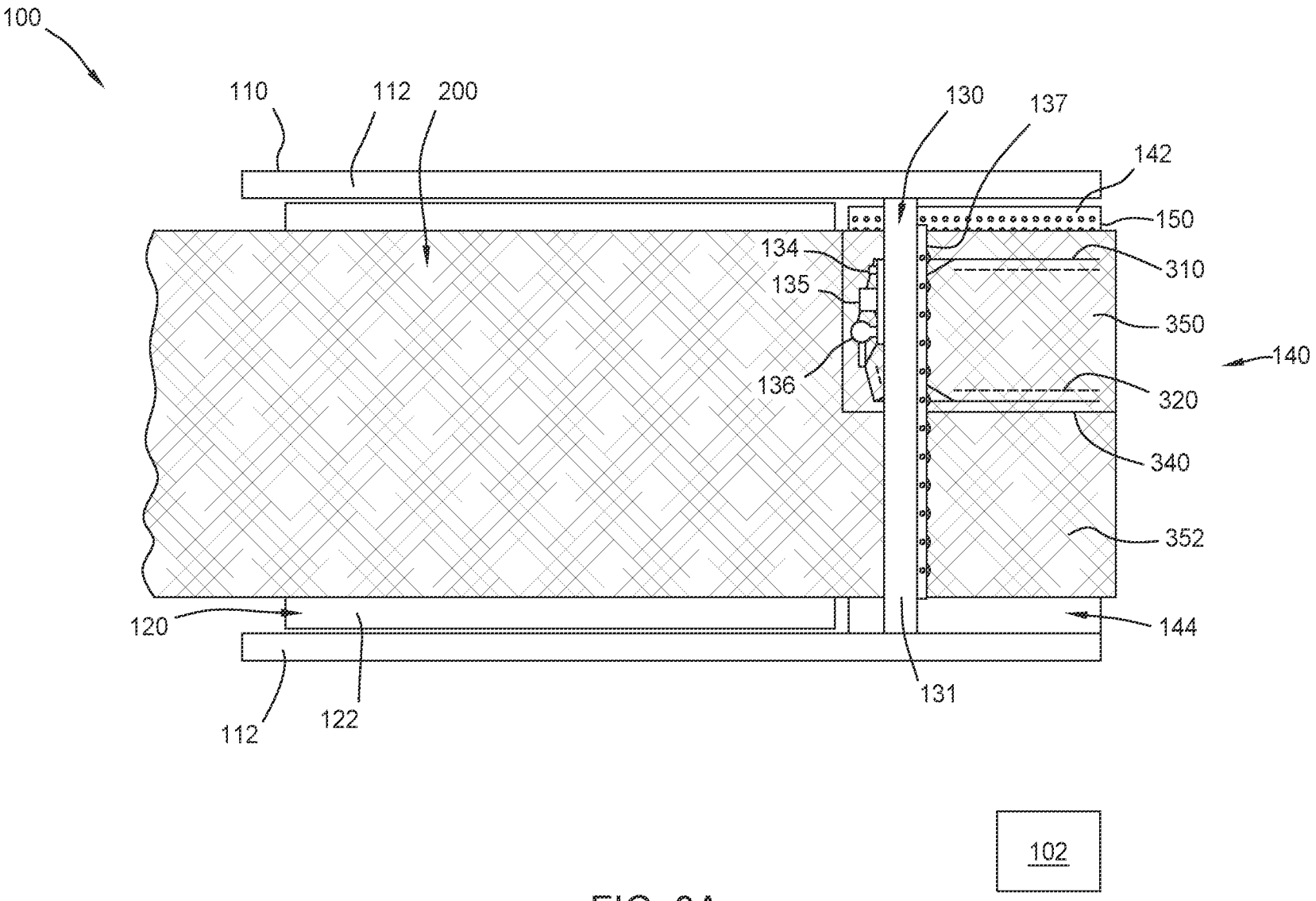
FIGS. 3A-3B illustrate an alternate method to make a garment component with the garment station.

FIG. 3A illustrate an alternative method of folding the single web to create a layered garment component with the garment station 100. The method of folding the single web to form the garment component is similar to the method discussed in FIGS. 2A-2H, except that the portion of the garment moved by the first platen 142 includes the first cut pattern and the adhesive.

FIG. 3A illustrates the garment station 100 with a single web 300 disposed therein. The single web 300 has already been cut by the cutting device 135 to include a first cut pattern 310. Adhesive 320 has already been applied to the web 300 by the adhesive dispenser 136. The adhesive 320 may be applied in an adhesive pattern. The first cut pattern 310 and the adhesive 320 remain attached to the web during most of the manufacturing process. Additionally, the single web 300 has already been transported onto the folding assembly 140 and cut to include a second cut pattern 340. The second cut pattern 340 at least partially frees a first web portion 350 from the web 300 to facilitate placing the first web portion 350 onto a second web portion 352. As shown, the first web portion 350 is cut free from the web 300 by the second cut pattern 340. As shown in FIG. 3A, the first web portion 350 of the web 300 includes the first cut pattern 310, the adhesive 320, and the second cut pattern 340. The second web portion 352 is still attached to the web 300. The first web portion 350 of the web 300 is engaged with the first platen 142 and the second web portion 352 of the web 300 is engaged with the second platen 144.

In some embodiments, the controller 102 instructs the folding assembly 140 to move the first platen 142 to place the first web portion 350 on the second web portion 352 to form an intermediate garment 354. The first web portion 350 is bonded to the second web portion 352 by the adhesive 320. Heat and pressure may be applied to activate and/or cure the adhesive 320.

Figure 3B:
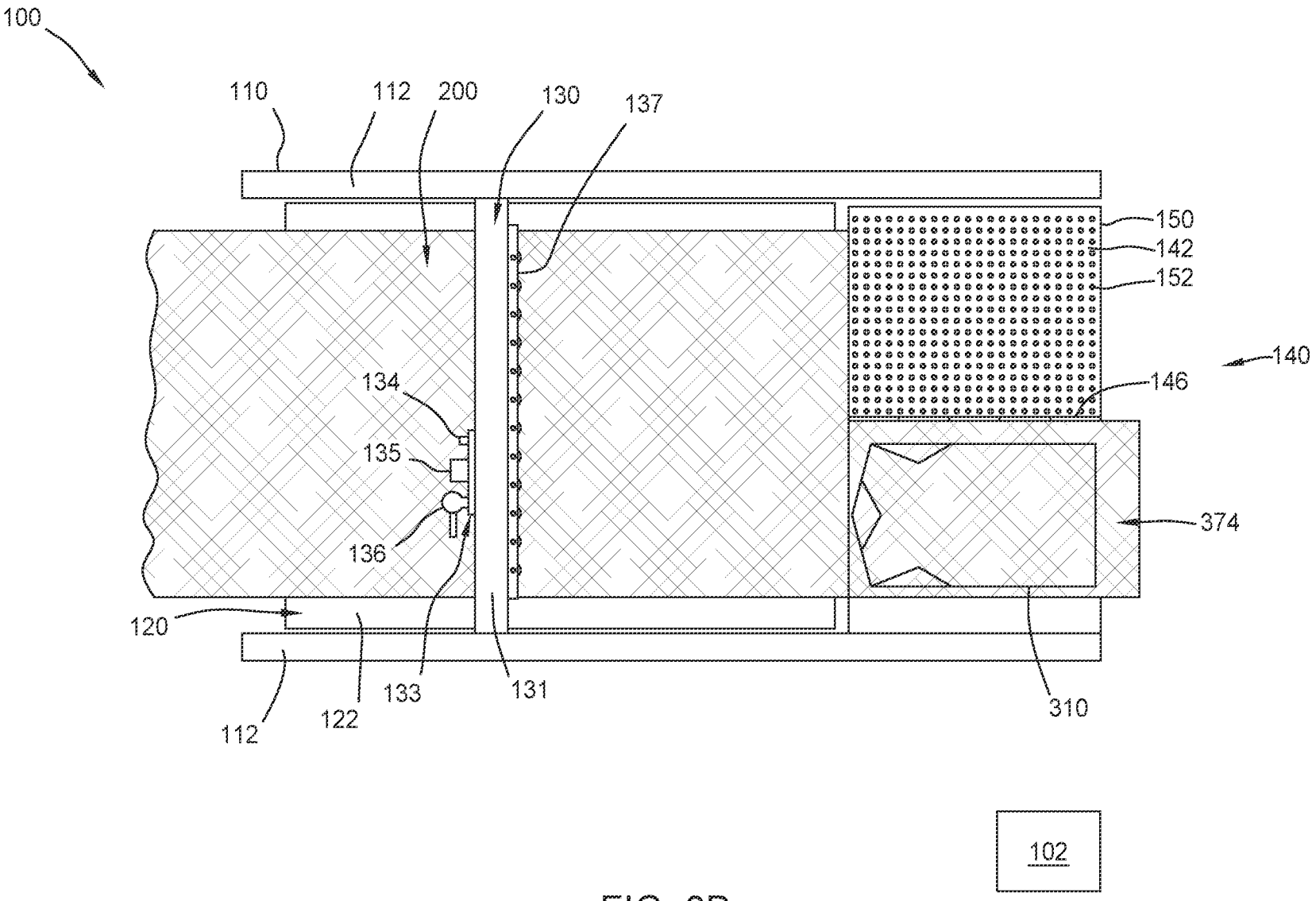

FIG. 3B illustrates the garment station 100 with the first platen 142 returned to the unfolded position. The first cut pattern 310 is shown as upward facing and is not obscured from view of the optical sensor 134, so the controller 102 does not have to rely on stored positional information of the first cut pattern 310 obtained by the optical sensor 134. The controller 102 may use the optical sensor 134 to direct the cutting device 135 about the x,y axes to cut the intermediate garment 354, such as cutting the second web portion 352, to form a finished garment component (not shown).

In some alternative embodiments, the single web is 200, 300 is cut to form cut patterns in the webs 200, 300 and adhesive is applied to the web 200, 300 while the web 200, 300 is positioned on the folding assembly 140 instead of the conveyor 120. A length of the single web 200, 300 sufficient to form a garment component is transported from the conveyor 120 to the folding assembly 140. The controller 102 then instructs the tool head 133 to move about the x,y axes to make the desired cut and adhesive patterns. If the cuts and adhesive are applied to the portion of the web engaged with the fixed platen, such as the second platen 144, the optical sensor 134 may be omitted. The optical sensor 134 may be omitted because the cut pattern and adhesive pattern are made based on a known point of reference by the controller 102, such as a pre-programed pattern, and the portion of the web engaged with the second platen 144 does not move while the first platen 142 moves. After the folding assembly 140 is actuated to bond the first and second web portions together to form the intermediate garment, the controller 102 may then use the same point of reference to cut the intermediate garment, including cutting the intermediate garment from the web 200, 300. For example, the controller 102 may cut the intermediate garment with a pre-programed pattern. In some embodiments of forming the garment component by cutting and applying adhesive on the folding assembly 140, the gripper 137 is omitted.

Figure 4:
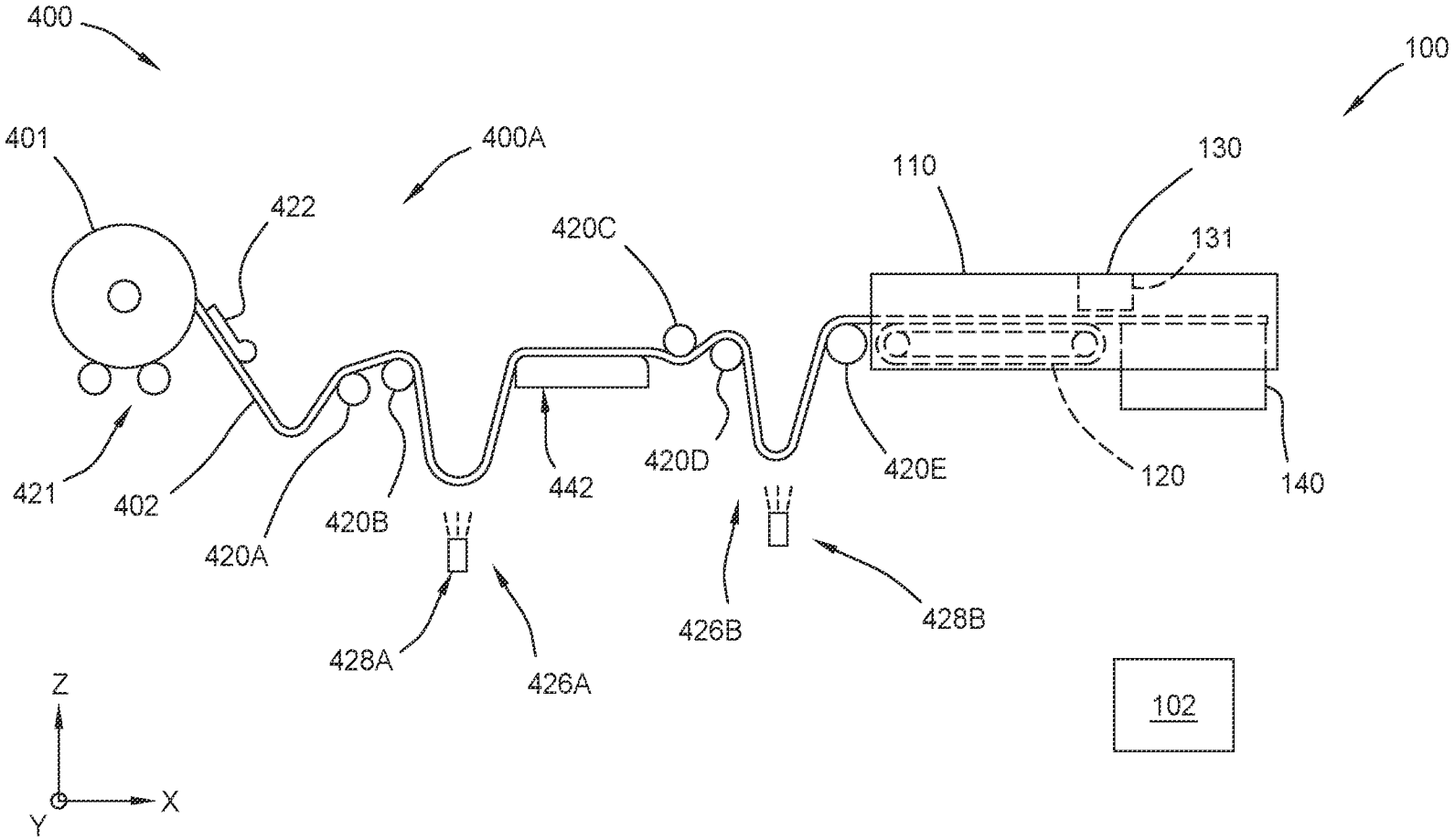
FIG. 4 is a schematic side view of an exemplary automated garment manufacturing system.

FIG. 4 is a schematic side view of an exemplary automated garment manufacturing system 400. The system 400 manufactures garments or garment components from a single web 402 of fabric, such as webs 200, 300. The manufactured garments may be a finished garment. The manufactured garment may also be a garment component that requires the addition of other garment components to form a finished garment.

The system 400 comprises a fabric transport system 400A and the garment station 100. The first fabric transport system 400A moves a single web 402 of fabric, such as webs 200, 300, from a first fabric roll 401. In some embodiments, and as shown in FIG. 4, the fabric transport system 400A includes a plurality of rollers 420, a roller system 421, a dancer 422, at least one fabric preparation system 426, and a relaxer station 442.

The first fabric roll 401 may rotate about its axis and dispense the web 402 along the x-axis of the system 400. The roller system 421 may include two rollers, and the roller system 421 feeds the web 402 through the system 400. At least one of the two rollers of the roller system 421 may be motorized such that the motorized roller contacts the fabric roll 401 and selectively rotates the fabric roll 401 at a selected speed, pulling or pushing the web 402 along the x-axis. In some embodiments, roller system 421 may be omitted and the roll 401 may be coupled to one or more actuators, gears, motors (continuous or step) that rotate at a selected speed pulling or pushing the web 402 along the x-axis. In some embodiments, the roll 401 is free to move but is not mounted on motorized shafts.

The relaxer stations 442 relaxes the web 402 as the web 402 is removed from the roll 401 and before the web 402 is processed by the garment station 100. The relaxer station 442 may be an air table that forces air through perforations in a surface of the air table. The surface of the air table may face the web 402 such that the air is forced against the web 402 to relaxes the web 402, beneficially reducing or eliminating wrinkles before processing at the garment station 100.

In some embodiments, the relaxer station 442 includes a heating element to heat air blown at the web 402. The heated air may beneficially relax the web 402 more than unheated air, and may decrease the time required for the relaxer station 442 to process the web 402. In some embodiments, at least one of the rollers 420 may be a heated roller (e.g., a roller 420 having a heating element) that heats the web 402 before the relaxer station 442. In some embodiments, a heating element may be positioned above the relaxer station 442 to heat the web 402. For example, a radiation heater, such as a heat lamp, may be used to heat the web 402.

In some embodiments, such as embodiments that heat the web 402, such as by blowing heated air at the web 402, the system 400 may further include at least one cooling station (not shown) to cool the web 402. In some embodiments, the cooling station includes a cooling air table to force air through perforations in a surface of the cooling air table and against the web 402 to cool the web 402. For example, the cooling station may use ambient or cooled air to cool the web 402.

The system 400 further includes the plurality of rollers 420 (e.g., rollers 420A-E) to facilitate the movement of the web 402. The rollers 420 may include any combination of fixed rollers, such as idler rollers, or motorized rollers, such as drive rollers or driven guide rollers. For example, actuators or motors may be located on at least a subset of the rollers 420, providing pull or push forces acting on the web 402. The rollers 420 may also include anti-wrinkle rollers or augers to spread the web 402 of fabric transversely to stretch wrinkles out of the fabric. In some embodiments, the anti-wrinkle rollers or augers may include a roller on each side of the web 402 or set of rollers on each side of the web 402. The rollers of each side may contact the web 402 at an angle that is not perpendicular to the web 402 such that each roller 420 pulls the web 402 towards the sides of the web 402 to release wrinkles. In some embodiments, the anti-wrinkle rollers or augers may include a roller that is perpendicular to the web 402 that spreads the web 402 as the web 402 passes over the anti-wrinkle roller or auger. In the depicted embodiment, motorized roller 420B pulls (e.g., feed or dispense) the web 402 as the roller systems 421 feeds the web 402 from the roll 401. Fixed roller 420A guides and prepares the web 402 to be pulled by the motorized rollers 420B.

The one or more fabric preparation systems 426 (e.g., fabric preparation systems 426A, 426B) provide slack in the web 402, which allows the web 402 to sag, while the fabric transport system 400A moves the web 402 through the system 400. The fabric preparation systems 426 prevent stretching or cause relaxation in the web 402 such that the slack in the web 402 allows the system 400 to move the web 402 without stretching the web 402, which beneficially helps maintain the web 402 in a low tension state. The slack may also relax and reduce wrinkles in the web 402. Each fabric preparation system 426 may include a motorized roller to pull the web 402 and a non-contact measurement sensor 428 (e.g., non-contact measurement sensors 428A, 428B) to measure the slack or monitor the stretching in the web 402. The non-contact measurement sensor 428 may be used to control a rotation speed of the motorized roller such that the motorized roller adjusts a rotation rate based on the non-contact measurement sensor 428. For example, in the fabric preparation system 426B, which is positioned before the garment station 100, the non-contact measurement sensor 428B may measure a distance (D) between the sensor 428B and the web 402. If the distance measured is outside a threshold, a rotation speed of a roller 420D be increased or decreased to either increase or decrease the slack in the web 402. Thus, the plurality of fabric preparation systems 426 use the non-contact measurement sensor 428 to control the motorized rollers to push and pull the web at such a rate so as to not stretch the web.

The system 400 may also include a dancer 422 to maintain a consistent tension in the web 402. The dancer 422 may include an idler roller mounted to a dancer arm and a sensor to detect a position of the idler roller. For example, the dancer arm may include any one of a potentiometer, encoder, or angle sensor to sense an angle of the dancer arm. The sensed angle is compared to a set or "zero" position to detect if the idler roller position has changed and a rotation speed of a roller 420 may be adjusted until the sensed angle returns to the set position. For example, in the depicted embodiment, a dancer 422 may rotate clockwise or counterclockwise as shown on the page if there is too little or too much tension in the web 402. The rotation speed of the roller 420B may then be increased or decreased to return the dancer 422 to the set position shown on the page.

In some embodiments, a shaker (not shown) may be used to shake the web 402 to relax the web 402. The shaker may comprise any one of air pulse systems or grippers or rollers coupled to movable or rotatable arms. The shaker may be used in addition to or instead of the relaxer station 442 or anti-wrinkle rollers or augers. In some embodiments, the relaxer station 442 may comprise the shaker.

As shown in FIG. 4, the web 402 is fed into the garment station 100 from the second relaxer station 426B. The web 402 is cut, adhesive is applied, and a plurality of garments or garment components, such as garment components 470, are formed using the garment station 100. The garment component 470 may be transferred to a different garment manufacturing system for finishing, such as the attachment of sleeves.

The system 400 has smaller footprint than other garment manufacturing processes since the garment station 100 manufactures a finished garment or garment component. The system 400 has a short and less expensive layout to produce a garment with a reduction in the subcomponents of the system 400 which also reduces maintenance costs. Another advantage of the system 400 is a reduced amount of work in progress on shut down because there is one garment processing station instead of multiple stations manipulating the web 402, such as a separate cutting and adhesive station. While the system 400 has a smaller footprint than other garment manufacturing processes, the system 400 may have less throughput of the web 402.

In an alternative embodiment of the system 400, the intermediate garment is not cut in the garment processing station. The intermediate garment is conveyed to a cutting station downstream of the garment station 100 for additional processing, such as cutting the intermediate garment into the garment component.

In some embodiments, the system 400 is controlled by the controller 102. In some embodiments, the system 400 includes a control system that includes the controller 102 or is in communication with the controller 102.

Additionally, creating a garment or garment component from a single web of fabric has additional advantages. Using a single web of fabric to make a garment or garment component prevents color mismatches. Less web is wasted because there is no need to index a portion of the fabric into a separate heat press station to ensure the adhesive is positioned within the heat press station for adhesive activation. Additionally, the controller may ascertain the position of the web during processing within the garment station 100, which may eliminate fiducial punching upstream of the garment station 100.

In some embodiments, the second cut pattern 240 is omitted and the web 200 may be folded onto the first cut pattern 210 and the adhesive 220 by the folding assembly 140. In some embodiments, the second cut pattern 340 is omitted and the folding assembly 140 may fold the web 300 including the first cut pattern 310 and adhesive 320 onto the second web portion 352.

Figure 5:
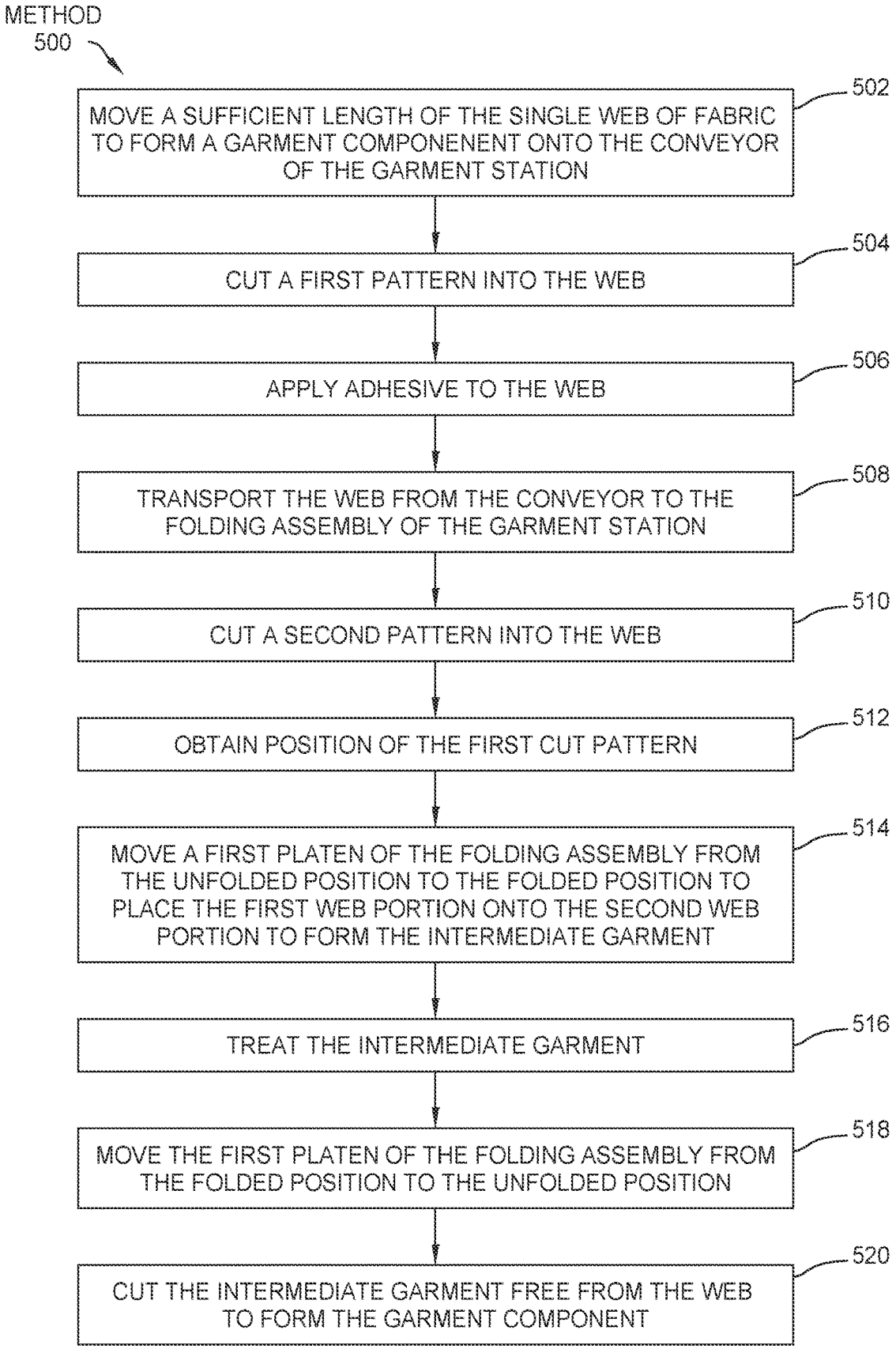
FIG. 5 is a flowchart of a method for an automated manufacturing of a garment component from a single web of fabric according to one embodiment.

FIG. 5 is a flowchart of a method 500 for an automated manufacturing of a garment component from a single web of fabric according to one embodiment. The controller 102 may control the fabric transport system 400A and the garment station 100 to complete each step of the method 500.

The method 500 begins at operation 502, where a sufficient length of a web of fabric to form a desired garment is indexed onto the conveyor 120 of the garment station 100. The web may be conveyed into the garment station 100 from the fabric transport system 400A.

At operation 504, a first cut pattern is cut into the web with the cutting device 135, such as the first cut pattern 210. The first cut pattern may be a pre-determined or selected pattern for a garment component, such as the back or front of a t-shirt. The first cut pattern remains attached to the web so that the first cut pattern moves within the garment station 100 as the web is moved.

At operation 506, adhesive is applied to the web with the adhesive dispenser 136. The adhesive may be applied in a pre-determined or pre-selected pattern for the garment component, such as being applied to form a seam. In some embodiments, the adhesive is applied to the web prior to or after cutting the first cut pattern with the cutting device 135 at operation 504. In some embodiments, the adhesive is applied concurrently with the web being cut to form the first cut pattern.

At operation 508, the web, including the first cut pattern and the adhesive, is transported from the conveyor 120 to the folding assembly 140. To transport the web, the gripper 137 is actuated to grip the web. In some embodiments, the gripper 137 may be further actuated to lift the web at least partially from the conveyor 120. The conveyor 120 and the gantry 130 are actuated to move synchronously to transport the web onto the folding assembly 140. The conveyor 120 and the gantry 130 may be coordinated to prevent or mitigate wrinkling of the web. Once the web is placed on the folding assembly 140, the gripper 137 is further actuated to release the web. In some embodiments, vacuum may be applied to the web once placed on the folding assembly 140, such as by the vacuum pump 170 connected to the first platen 142 and/or second platen 142.

At operation 510, the second cut pattern is cut into the web, such as the second cut pattern 240. The second cut pattern may sever a first web portion from a second web portion. In some embodiments, the second cut pattern does not sever the first web portion from the second web portion. In some embodiments, the second cut pattern is cut before the first cut pattern or simultaneously with the first cut pattern. The second cut pattern may be cut prior to the application of the adhesive. Operation 510 may occur before or after operation 508. For example, the second cut pattern may be formed in the web after the first cut pattern on the conveyor prior to being moved to the folding assembly 140.

At operation 512, the optical sensor 134 is used to obtain the position of the web, such as the position of the first cut pattern. In some embodiments, the optical sensor is used to obtain the positions of the second cut pattern and/or the pattern of the adhesive in addition to the first cut pattern.

At operation 514, the first platen 142 is moved from the unfolded position to the folded position to place the first web portion onto the second web portion to form the intermediate garment. The first and second web portion may be held against the folding assembly by the influence of a vacuum. For example, the first web portion may be held against the first platen 142 under the influence of the vacuum pump 170.

At operation 516, the intermediate garment is treated. The treatment may include a heat treatment, such as applying heat to the assembled first and second web portions to activate and/or cure the adhesive. The treatment may also include applying pressure to the assembled first and second web portions, such as applying pressure during the heat treatment, to aid in bonding the first web portion to the second web portion to form the intermediate garment. The treatment may also include exposing the intermediate garment to moisture, such as humid air.

At operation 518, the first platen 142 of the folding assembly 140 is moved from the folded position to the unfolded position. The web may be released from the folding assembly 140 prior to the unfolding, such as by turning off the vacuum pump 170.

At operation 520, the intermediate garment is cut free from the web to form the garment component, such as by making a third cut pattern. The intermediate garment may be cut based on the obtained position of the first cut pattern, the second cut pattern, and/or the adhesive. In some embodiments, only the second web portion of the intermediate garment is cut. After the intermediate garment is cut to form the garment component, the garment component is removed from the surface of the second platen 144. The method 500 may start over again at operation 502 to create an additional garment component. In some embodiments, the finished garment may be treated with moisture, such as blowing humid air at the finished garment, to cure the adhesive.

Figure 6:
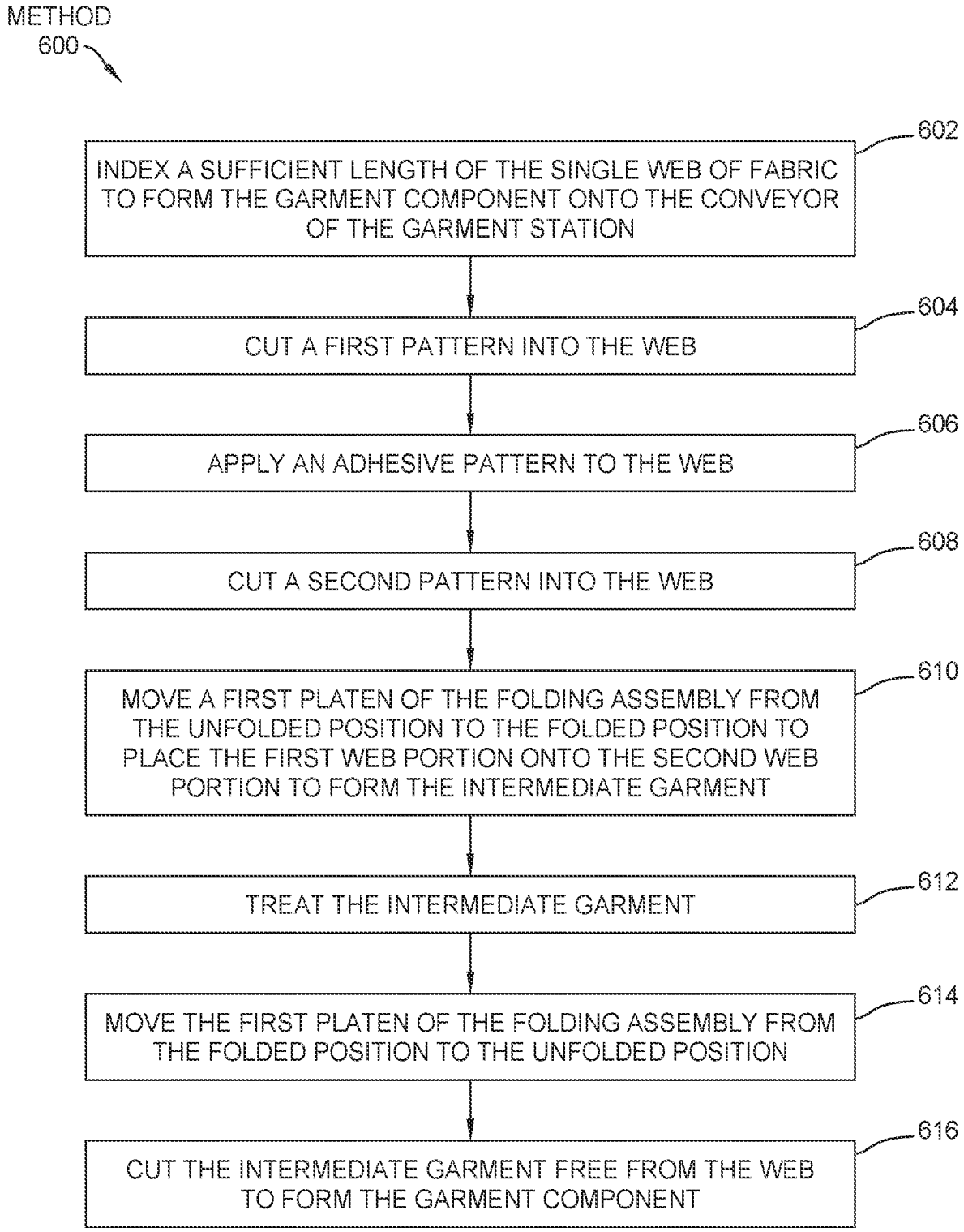
FIG. 6 is a flowchart of a method for an automated manufacturing of a garment component from a single web of fabric according to one embodiment.

FIG. 6 is a flowchart of a method 600 for an automated manufacturing of a garment component from a single web of fabric according to one embodiment. The controller 102 may control the fabric transport system 400A and the garment station 100 to complete each step of the method 600.

The method 600 begins at operation 602, where a sufficient length of a web of fabric to form a desired garment is indexed onto the folding assembly 140 from the conveyor 120. The web may be conveyed into the garment station 100 from the fabric transport system 400A.

At operation 604, a first pattern is cut into the web placed on the folding assembly 140 with the cutting device 135, such as the first cut pattern 310. The first cut pattern may be a pre-determined or selected pattern for a garment component, such as the back or front of a t-shirt. The first cut pattern remains attached to the web.

At operation 606, adhesive is applied to the web with the adhesive dispenser 136. The adhesive may be applied in a pre-determined or pre-selected pattern for the garment component, such as being applied to form a seam. In some embodiments, the adhesive is applied to the web prior or after cutting the first cut pattern with the cutting device 135 at operation 604. In some embodiments, the adhesive is applied concurrently with cutting the web to form the first cut pattern.

At operation 608, a second cut pattern is cut into the web on the folding assembly 140. The second cut pattern can include a cut along the fold line of the web. In some embodiments, the second cut pattern does not include a cut along the fold line of the web. In some embodiments, the second cut pattern is cut before the first cut pattern or simultaneously with the first cut pattern. The second cut pattern may be cut prior to the application of the adhesive.

At operation 610, the first platen 142 is moved from the unfolded position to the folded position to place the first web portion onto the second web portion to form an intermediate garment. The first and second web portion may be held against the folding assembly by the influence of a vacuum. For example, the first web portion may be held against the first platen 142 under the influence of the vacuum pump 170.

At operation 612, the intermediate garment is treated. The treatment may include a heat treatment, such as applying heat to the assembled first and second web portions to activate and/or cure the adhesive. The treatment may also include applying pressure to the assembled first and second web portions, such as applying pressure during the heat treatment, to aid in bonding the first web portion to the second web portion to form the intermediate garment. The treatment may include exposing the intermediate garment to moisture, such as humid air.

At operation 614, the first platen 142 is moved from the folded position to the unfolded position. The web may be released from the folding assembly 140 prior to the unfolding, such as by turning off the vacuum pump 170.

At operation 616, the intermediate garment is cut free from the web to form the garment component, such as by making a third cut pattern. The intermediate garment may be cut based on the obtained position of the first cut pattern, the second cut pattern, and/or the adhesive. In some embodiments, only the second web portion of the intermediate garment is cut. After the intermediate garment is cut to form the garment component, the garment component is removed from the surface of the second platen 144. The method 600 may start over again at operation 602 to create an additional garment component. In some embodiments, the finished garment may be treated with moisture, such as blowing humid air at the finished garment, to cure the adhesive.

The garment component of finished garment may need to be turned inside out to hide the seams made by the adhesive.

An operator may select the size and type of the garment portion being formed with a user interface of the controller 102. For example, an operator may choose between a small, medium, and large t-shirt on a user interface of the controller 102. The controller 102 will then instruct the garment station 100 to form a first cut pattern, apply an adhesive, and cut the intermediate garment to form the garment portion of the desired size and type.

In some embodiments, the first cut pattern 210 may be formed in the first web portion 250 on the conveyor 120 and then moved from the conveyor 120 to the first platen 142 by the gantry 130. The first platen 142 may be moved to place the first web portion 250 including the first cut pattern 210 onto the second web portion 252. In some embodiments, the first cut pattern 310 may be formed in the second web portion 352 on the second platen 144 and the second cut pattern 340 may be formed in the first web portion 350 on the first platen 142. The first platen 142 may be moved to place the first web portion 350 onto the second web portion 352 including the first cut pattern 310.

In some embodiments, both the first and second web portions may be cut to have a cut pattern prior to moving the first platen to the folded position to place the first web portion onto the second web portion.

In the current disclosure, reference is made to various embodiments. However, it should be understood that the present disclosure is not limited to specific described embodiments. Instead, any combination of the following features and elements, whether related to different embodiments or not, is contemplated to implement and practice the teachings provided herein. Additionally, when elements of the embodiments are described in the form of "at least one of A and B," it will be understood that embodiments including element A exclusively, including element B exclusively, and including element A and B are each contemplated. Furthermore, although some embodiments may achieve advantages over other possible solutions or over the prior art, whether or not a particular advantage is achieved by a given embodiment is not limiting of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, embodiments described herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments described herein may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations or block diagrams of methods, apparatuses (systems), and computer program products according to embodiments of the present disclosure. It will be understood that each operation of the flowchart illustrations or block diagrams, and combinations of operations in the flowchart illustrations or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the operation(s) of the flowchart illustrations or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the operation(s) of the flowchart illustrations or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the operation(s) of the flowchart illustrations or block diagrams.

The flowchart illustrations and block diagrams in the Figures illustrate the architecture, functionality, and operation of possible implementations of systems, methods, and computer program products according to various embodiments of the present disclosure. In this regard, each operation in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams or flowchart illustrations, and combinations of blocks in the block diagrams or flowchart illustrations, can be implemented by special purpose hardware-based systems that perform the specified functions or acts, or combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A method of making a garment component from a single web of fabric, comprising:

moving a length of a web of fabric onto a conveyor of a garment station to make a garment component;

cutting a first cut pattern in the web disposed on the conveyor with a cutting device of the garment station;

applying an adhesive to the web to disposed on the conveyor with an adhesive dispenser of the garment station;

transporting the web from the conveyor to a folding assembly of the garment station;

cutting a second cut pattern in the web with the cutting device;

moving a first platen of the folding assembly from an unfolded position to a folded position to place a first portion of the web onto a second portion of the web to form an intermediate garment;

treating the intermediate garment;

moving the first platen of the folding assembly from the folded position to the unfolded position; and cutting the intermediate garment free from the web with the cutting device to form the garment component.

2. The method of claim 1, further comprising:

obtaining a position of the first cut pattern with an optical sensor of the garment station after transporting the web to the folding assembly; and using the obtained position of the first cut pattern to cut the intermediate garment free from the web to form the garment component.

3. The method of claim 1, wherein the folding assembly includes a second platen, wherein the first platen is foldable over the second platen as the first platen moves from the unfolded position to the folded position.

4. The method of claim 3, wherein the second portion of the web includes the first cut pattern, and wherein the first portion of the web is positioned on the first platen and the second portion of the web is positioned on the second platen after the web is transported to the folding assembly from the conveyor.

5. The method of claim 3, wherein the first portion of the web includes the first cut pattern, and wherein the first portion of the web is positioned on the first platen after the web is transported to the folding assembly from the conveyor.

6. The method of claim 1, further comprising securing the first web portion of the web to the first platen prior to moving the first platen to the folded position.

7. The method of claim 1, wherein the treatment is one or more of: heat, pressure, or moisture, and wherein the treatment is sufficient to activate the adhesive.

8. The method of claim 1, wherein forming the intermediate garment includes folding the web with the folding assembly.

9. The method of claim 1, wherein transporting the web from the conveyor to the folding assembly includes gripping and lifting the web with a gripper of the garment station.

10. The method of claim 1, wherein the garment station, further comprises:

a frame, the conveyor being coupled to the frame; and a gantry disposed over the conveyor, the gantry including a tool head moveable over the conveyor;

wherein:

the folding assembly includes the first platen moveable relative to a second platen between the folded position and the unfolded position, the first platen is substantially co-planar with the second platen in the unfolded position, and the first platen is disposed above the second platen in the folded position.

11. The method of claim 10, further comprising:

the first platen including a plurality of perforations;

a vacuum pump coupled to the perforations and configured to provide a vacuum to hold the first portion against the first platen as the first platen moves from the unfolded position to the folded position.

12. The method of claim 11, wherein the first platen includes one or more heating elements.

13. The method of claim 10, wherein the gantry further comprises a gripper configured to grip the web of fabric disposed on the conveyor.

14. The method of claim 10, wherein the tool head includes an optical sensor, the cutting device, and the adhesive dispenser.

15. The method of claim 1, wherein the garment component is a t-shirt body.

16. The method of claim 1, wherein cutting the intermediate garment free from the web includes cutting the intermediate garment to form one or more contours.

17. The method of claim 16, wherein the one or more contours include a shoulder joint and a neckline.

18. The method of claim 1, further comprising applying a vacuum to the first portion to hold the first portion against the first platen as the first platen is moved from the unfolded position to the folded position.

19. The method of claim 18, further comprising stopping the application of the vacuum after the first platen is in the folded position.

* * * * *